US006656652B2

(12) United States Patent
Ishii et al.

(10) Patent No.: US 6,656,652 B2
(45) Date of Patent: Dec. 2, 2003

(54) ELECTROPHOTOGRAPHIC PHOTOSENSITIVE MEMBER, PROCESS CARTRIDGE, AND ELECTROPHOTOGRAPHIC APPARATUS

(75) Inventors: Shuji Ishii, Shizuoka (JP); Kazushige Nakamura, Kanagawa (JP); Noriyuki Takagi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/962,130

(22) Filed: Sep. 26, 2001

(65) Prior Publication Data

US 2002/0064721 A1 May 30, 2002

(30) Foreign Application Priority Data

Sep. 29, 2000 (JP) ..... 2000-299617

(51) Int. Cl.[7] ..... G03G 5/047; G03G 5/10

(52) U.S. Cl. ..... 430/59.3; 430/59.2; 430/60; 430/64; 430/69; 399/116; 399/159

(58) Field of Search ..... 430/69, 59.1, 59.2, 430/59.4, 59.5, 78, 127, 60, 64, 65, 59.3; 399/116, 159

(56) References Cited

U.S. PATENT DOCUMENTS

| | | | | |
|---|---|---|---|---|
| 5,492,786 A | * | 2/1996 | Sugimura et al. | 430/96 |
| 5,596,388 A | * | 1/1997 | Ohkubo et al. | 399/111 |
| 5,932,722 A | * | 8/1999 | Hirai et al. | 430/78 |
| 6,004,710 A | | 12/1999 | Takagi et al. | 430/66 |
| 6,057,071 A | * | 5/2000 | Ohashi et al. | 430/78 |
| 6,165,662 A | * | 12/2000 | Kato et al. | 430/96 |

FOREIGN PATENT DOCUMENTS

| | | | |
|---|---|---|---|
| EP | 0428102 A1 * | 5/1991 | 430/59.5 |
| EP | 940726 | 9/1999 | |
| EP | 1004939 | 5/2000 | |
| JP | 5-98181 | 4/1993 | |
| JP | 5-263007 | 10/1993 | |
| JP | 9-244286 | * 9/1997 | |
| JP | 10-158534 | 6/1998 | |
| JP | 10-158535 | 6/1998 | |
| JP | 10-237339 | 9/1998 | |
| JP | 2000-171989 | 6/2000 | |

OTHER PUBLICATIONS

Derwent Machine Translation of JP 9–244286, (pub 9/97), Sep. 1997.*

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member includes a support, and a charge generation layer and a charge transport layer provided on the support in this order. The charge generation layer contains a charge-generating material in an amount of more than 2 parts by weight and not more than 5 parts by weight based on 1 part by weight of a binder resin, and the support has a surface roughness in which a maximum height RmaxD, a 10-point average roughness Rz, an arithmetic-mean roughness Ra and an unevenness average distance Sm fulfill the following conditions:

$$1.2\ \mu m \leqq RmaxD \leqq 5.0\ \mu m,$$

$$1.2\ \mu m \leqq Rz \leqq 3.0\ \mu m,$$

$$0.15\ \mu m \leqq Ra \leqq 0.5\ \mu m,$$

$$30\ \mu m < Sm \leqq 80\ \mu m.$$

Also disclosed are a process cartridge and an electrophotographic apparatus which have the electrophotographic photosensitive member.

16 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus. More particularly, it relates to an electrophotographic photosensitive member making use of a support comprising aluminum and having been surface-roughened, a process cartridge, and an electrophotographic apparatus which have such an electrophotographic photosensitive member.

2. Related Background Art

Electrophotographic apparatus can enjoy high speed and high print quality, and are utilized in the field of copying machines and laser beam printers. As electrophotographic photosensitive members used in such electrophotographic apparatus, organic electrophotographic photosensitive members making use of organic photoconductive materials have been brought forth and have come into wide use. Also, with respect to construction, electrophotographic photosensitive members have been changed over from electrophotographic photosensitive members of an electric-charge movement type complex structure or of a single-layer type, in which a charge-generating material has been dispersed in a binder resin, to electrophotographic photosensitive members of a function-separated type in which a charge generation layer and a charge transport layer are functionally separated, and their performances have been improved. The latter function-separated type electrophotographic photosensitive members are so constructed that a subbing layer is formed on an aluminum support and then the charge generation layer and the charge transport layer are formed thereon. Such construction constitutes the prevailing construction today.

With progress in the development of the electrophotographic apparatus, electrophotographic photosensitive members have also been required to provide images having a higher quality level. With regard to improvements in repeating stability and environmental stability of electrophotographic photosensitive members, the charge generation layer, the charge transport layer, and the subbing layer all have an important influence on electrophotographic performance with regard to sensitivity, image quality, and repeating stability. Moreover, as the support, various types, such as extruded tubes, ED tubes (drawn tubes) and EI tubes, have come into use for the purpose of reducing production cost and better preventing faulty images.

However, if the charge generation layer is superposed on the support as it is, any laser light reflects from the support to cause interference fringes. In order to prevent this, it is necessary for the support surface to be roughened by some means. Depending on its shape, the roughened surface is required to have a roughness of about 0.6 $\mu$m or smaller as a 10-point average roughness (Rz).

Methods for surface roughening include centerless grinding and honing. The honing method includes dry honing and wet honing, either of which may be used. The wet (liquid) honing method is a method in which a powdery abrasive (abrasive grains) is suspended in a liquid such as water and the suspension formed is sprayed on the surface of a support at a high rate to roughen its surface. The surface roughness can be controlled by the pressure or rate of spraying and the quantity, type, shape, size, hardness, specific gravity or suspension concentration of the abrasive. Similarly, the drying honing method is a method in which an abrasive is sprayed on the surface of a support at a high rate by the aid of air to roughen its surface, and the surface roughness can be controlled in the same manner as in the wet honing method. The abrasive used in these wet honing and dry honing methods may include particles such as silicon carbide particles, alumina particles, zirconia particles, stainless steel particles, iron particles, glass beads and plastic shots.

However, in such dry honing (blasting) and in liquid honing making use of shapeless alumina abrasive grains, abrasive grains may stick in the support surface, appearing as black dots in white images in a reversal development system or blank areas in black images in a regular development system when an electrophotographic photosensitive member is produced using such a support. In liquid honing making use of glass beads, glass may easily break to stick in the support surface to make it difficult to control surface roughness. Accordingly, it is common to roughen the support surfaces by liquid honing using spherical alumina abrasive grains or spherical stainless steel abrasive grains as the abrasive, and thereafter to form thereon the subbing layer, the charge generation layer and so forth to produce electrophotographic photosensitive members.

In a charge generation layer formed of a binder resin in which a charge-generating material pigment has been dispersed, in general, a sufficient sensitivity is easy to attain when the proportion of the pigment is larger. Also, since in recent years there has been an increasing demand for electrophotographic apparatus to achieve higher speed and higher image quality, such a larger proportion of the pigment is used because it is more effective for improving performance. If, on the other hand, the pigment is in a small proportion, the charge generation layer may cause a positive or negative ghost to appear, depending on the electrophotographic processes. In such a case, too, it has been effective to use the pigment in a large proportion. However, with an increase in pigment proportion, the charge generation layer that is formed may have poor film properties and also tends to be affected by the surface shape of the support. Also, in the charge generation layer having such a large pigment proportion, poor film properties may result with an increase in the surface roughness of the support, tending to cause faulty images.

The charge transport layer may wear when formed as a surface layer of the electrophotographic photosensitive member. Accordingly, with respect to the useful life of the member, it is commonly more effective for the layer to have a larger thickness. However, with an increase in layer thickness, the reproducibility of electrostatic latent images may be reduced, and, in the case of digital machines, poor reproducibility of individual dots of exposure spots may result. In digital machines which aim for higher precision, it is difficult to accomplish the requisite image quality and life thereof. Also, where the charge transport layer is formed in a thin film for the purpose of achieving a higher image quality, the surface roughness and the layer thickness may correlate to cause black dots or blank areas, and hence it is more difficult to accomplish both.

SUMMARY OF THE INVENTION

The present invention was made taking account of the above problems. Accordingly, an object of the present invention is to provide an electrophotographic photosensitive member in which any interference fringes do not appear at the time of image formation and which does not cause any faulty images, such as black dots, blank areas, and ghosts, and to provide a process cartridge and an electrophotographic apparatus which have such an electrophotographic photosensitive member.

More specifically, the present invention provides an electrophotographic photosensitive member comprising a support, and a charge generation layer and a charge transport layer provided on the support in this order, wherein the charge generation layer contains a charge-generating material in an amount of more than 2 parts by weight and not more than 5 parts by weight based on 1 part by weight of a binder resin, and the support has a surface roughness in which a maximum height (RmaxD), a 10-point average roughness (Rz), an arithmetic-mean roughness (Ra) and an unevenness average distance (Sm) fulfill the following conditions:

$$1.2\ \mu m \leqq RmaxD \leqq 5.0\ \mu m,$$

$$1.2\ \mu m \leqq Rz \leqq 3.0\ \mu m,$$

$$0.15\ \mu m \leqq Ra \leqq 0.5\ \mu m,$$

$$30\ \mu m < Sm \leqq 80\ \mu m.$$

The present invention also provides a process cartridge and an electrophotographic apparatus which have such an electrophotographic photosensitive member.

DETAILED DESCRIPTION OF THE PREFERRED EMBODIMENTS

The electrophotographic photosensitive member comprises a support, and a charge generation layer and a charge transport layer formed on the support in this order.

Figure 1:
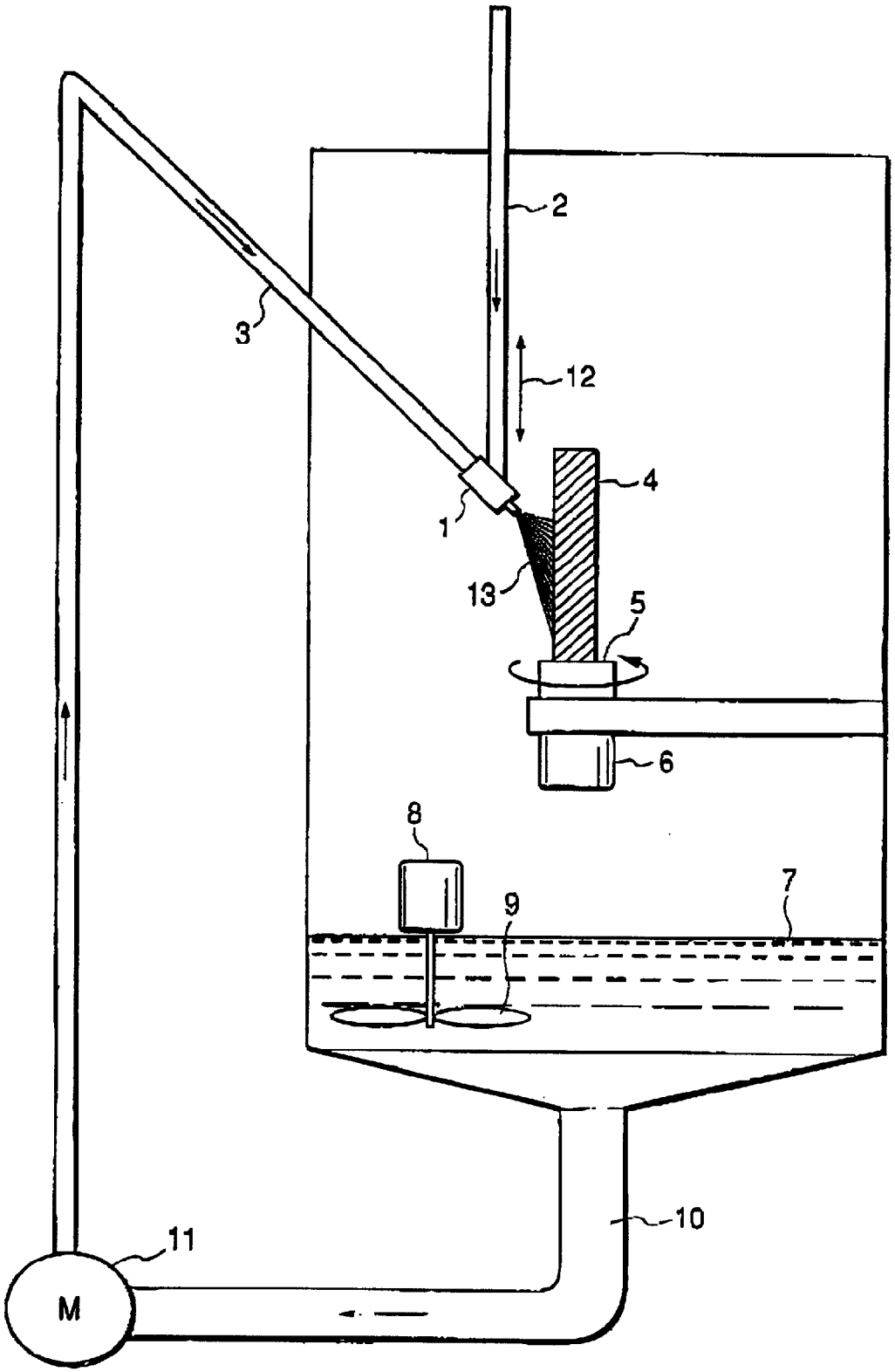
FIG. 1 is a schematic view showing the construction of a liquid honing apparatus.
Figure 2:
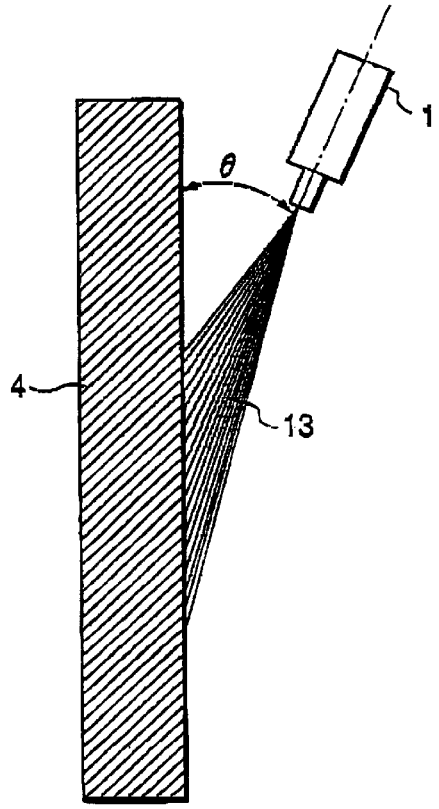
FIG. 2 is an enlarged view showing the construction of the liquid honing apparatus in the vicinity of its support.

The support used in the present invention may comprise a support formed of a cut tube or a drawn tube, and is obtained by liquid honing in which, as shown in FIG. 1, honing abrasive grains 13 such as spherical alumina or zirconia abrasive grains are sprayed on the surface of a honing object 4 (such as an aluminum cylindrical support). Thereafter, at least a subbing layer and the charge generation layer are formed thereon.

The liquid honing method, which may be carried out using a liquid honing apparatus shown in FIG. 1, is a method in which a suspension (honing liquid) 7 prepared by suspending honing abrasive grains 13 in a suspending medium is jetted against the honing object 4 from the tip of a slender nozzle 1 with air pressure to spray the abrasive grains 13 thereon to roughen its surface.

In FIG. 1, schematically showing the construction of the liquid honing apparatus, reference numeral 1 denotes a honing nozzle; 2 denotes an air feed pipe; 3 denotes a honing-liquid circulation pipe; 4 denotes a honing object (support); 5 denotes a honing-object stand; 6 denotes a drive rotary motor; 7 denotes a honing liquid (suspension); 8 denotes a stirring motor; 9 denotes a stirring propeller; 10 denotes a honing-liquid feed and collection pipe; 11 denotes a honing-liquid circulation pump; 12 denotes nozzle movement directions; and 13 denotes honing abrasive grains.

As the suspending medium of the honing liquid 7, water may be used. As media (the honing abrasive grains), alumina, zirconia or stainless steel beads may be used. The abrasive grains used in this liquid honing method have particle diameters of from about 5 $\mu$m to hundreds of micrometers. The type and particle diameter of these may be selected depending on the purposes for which they are used. The abrasive grains may particularly preferably have particle diameters of from 5 $\mu$m to 100 $\mu$m.

These media (abrasive grains) may be mixed in the suspending medium (chiefly water) in a proportion of from 2% to 30% by weight. If the media (abrasive grains) is in a too small proportion, a low efficiency of honing may result. If it is in a too large proportion, the suspension may have so poor a flowability as to be spouted from the nozzle in a small quantity or not to be spouted. Accordingly, it may preferably be mixed in a proportion of from 5% to 25% by weight.

In the liquid honing method, the honing liquid (suspension) 7, in which the abrasive grains have been suspended, is circulated by means of the honing-liquid circulation pump 11 and, where the nozzle has a jet orifice having a circular shape, is spouted from the tip of a nozzle having an orifice diameter of from 5 mm to 20 mm and is jetted against the honing object (support) 4. If it is circulated in an amount of from 5 liters to 50 liters, the surface roughness does not so differ when the suspension is jetted to the honing object. The pressure of air applied when the suspension is jetted makes the roughness greatly different. This pressure of air may commonly be from 0.01 MPa to 0.6 MPa. If it is lower than 0.01 MPa, a low efficiency of honing may result. If it is higher than 0.6 MPa, the surface tends to have too large a roughness.

In the case when spherical alumina abrasive grains are used, the abrasive grains may contain particles having an average particle diameter of from 20 to 30 $\mu$m and a particle size distribution of from 2 to 40 $\mu$m. Abrasive grains having a particle size distribution which is sharp to a certain extent can be produced, but those having no small-diameter particles at all can not be produced without resulting in a high cost.

The smaller the distance between the tip of the nozzle 1 and the surface of the honing object (support) 4, the better the efficiency. In general, however, in a method in which the nozzle 1 is moved while a cylindrical article is rotated, the honing may become uneven if the nozzle is set too close. Hence, the honing may be carried out setting the nozzle tip at a distance of from 10 mm to 400 mm. The nozzle may be moved at a speed of from about 0.2 m to about 2 m per minute. Commonly employed is a method of honing in which the nozzle is moved while the honing object is rotated. The higher the number of revolutions, the less the honing become uneven. Preferably, the honing object may be rotated at a speed of from 0.5 $s^{-1}$ to 10 $s^{-1}$, which may be regulated according to the speed of movement of the nozzle. The abrasive grains spouted from the nozzle collide softly against the honing object under the influence of the water spouted out simultaneously. Hence, the abrasive grains may provide less impact than in the case of dry sand blasting, which makes use of no suspending medium (water). Thus, the surface thus roughened can have a roughness smaller than that roughened by dry sand blasting under the same conditions, and also the abrasive grains may break less. In dry sand blasting and liquid honing, the surface roughening is commonly considered to be due to surface scraping. In practice, however, the surface is little scraped, and the surface undergoes plastic deformation to become concave chiefly because of the impact of the abrasive grains colliding against it. This is liable to occur especially when spherical abrasive grains are used.

Accordingly, in dry sand blasting and liquid honing, when the abrasive grains are sprayed all over the surface, the surface roughness may little differ any longer even if the abrasive grains collide under the same conditions.

In the case of roughening the surface by liquid honing or blasting, the abrasive grains sprayed may rather be made to strike the honing object surface obliquely at a small angle than be made to strike it perpendicularly. This broadens the honing area at the time of the spraying of abrasive grains to tend to decrease the unevenness.

After the step of roughening the support surface by liquid honing and before the charge generation layer is formed, the surface is usually cleaned to remove any abrasive (abrasive grains), abrasive liquid, dust, oily substance, finger prints and so forth having adhered thereto. In the step of cleaning the support, in order to improve the cleanness of the support, it is effective to use an auxiliary agent such as a surface-active agent in combination with water, or to exert a cavitation effect produced by the oscillation of ultrasonic waves, to jet compress air from a jet nozzle, or to use a brush or blade in combination.

In the present invention, the charge generation layer contains a charge-generating material in an amount of more then 2 parts by weight and not more than 5 parts by weight based on 1 part by weight of a binder resin. In the case when such a charge generation layer having a large charge-generating material pigment proportion, the support must have a surface roughness that fulfills the following conditions.

First, it has a maximum height (RmaxD) of from 1.2 $\mu$m to 5.0 $\mu$m, and particularly preferably from 1.2 $\mu$m to 4.5 $\mu$m.

Second, it has a 10-point average roughness (Rz) of from 1.2 $\mu$m to 3.0 $\mu$m, and particularly preferably from 1.2 $\mu$m to 2.0 $\mu$m.

Third, it has an arithmetic-mean roughness (Ra) of from 0.15 $\mu$m to 0.5 $\mu$m, and particularly preferably from 0.15 $\mu$m to 0.3 $\mu$m.

Fourth, it has uneveness average distance (Sm) of from larger than 30 $\mu$m to 80 $\mu$m, and particularly preferably from 31 $\mu$m to 80 $\mu$m.

The surface roughness is measured with a surface roughness meter SURFCORDER SE3500 (trade name), manufactured by Kosaka Kenkyusho, according to JIS B0601 (1994), at a cut-off of 0.8 mm and a measurement length of 8 mm. The arithmetic-mean roughness (Ra), the 10-point average roughness (Rz) and the unevenness average distance (Sm) have values set according to JIS B0601 (1994), and the maximum height (RmaxD) shows Rmax DIN.

If the 10-point average roughness (Rz) is smaller than 1.2 $\mu$m, interference fringes tend to occur. If it is larger than 3.0 $\mu$m, the subbing layer or the charge generation layer can not completely cover the support surface, tending to cause faulty images. Especially when the charge-generating material pigment is in a large proportion, the pigment tends to re-agglomerate at protrusions of the support surface after it has been dispersed, tending to cause faulty images.

The charge-generating material used in the electrophotographic photosensitive member of the present invention may include, e.g., pyrylium dyes, thiapyrylium dyes, phthalocyanine pigments, anthanthrone pigments, dibenzpyrenequinone pigments, pyranthrone pigments, azo pigments such as trisazo pigments and disazo pigments, indigo pigments, quinacridone pigments and asymmetric quinocyanine.

In particular, in the case of electrophotographic photosensitive members for digital machines, phthalocyanine pigments are advantageous among these charge-generating materials, because of their photosensitivity adaptable to a broad range of wavelengths of infrared lasers or visible-light lasers. Also, among phthalocyanine pigments, oxytitanium phthalocyanine, chlorogallium phthalocyanine, hydroxygallium phthalocyanine, dihydroxysilicon phthalocyanine, dialkoxyhydroxysilicon phthalocyanines, dihydroxysilicon phthalocyanine dimers and metal-free phthalocyanines are particularly advantageous because of their high sensitivity.

Figure 4:
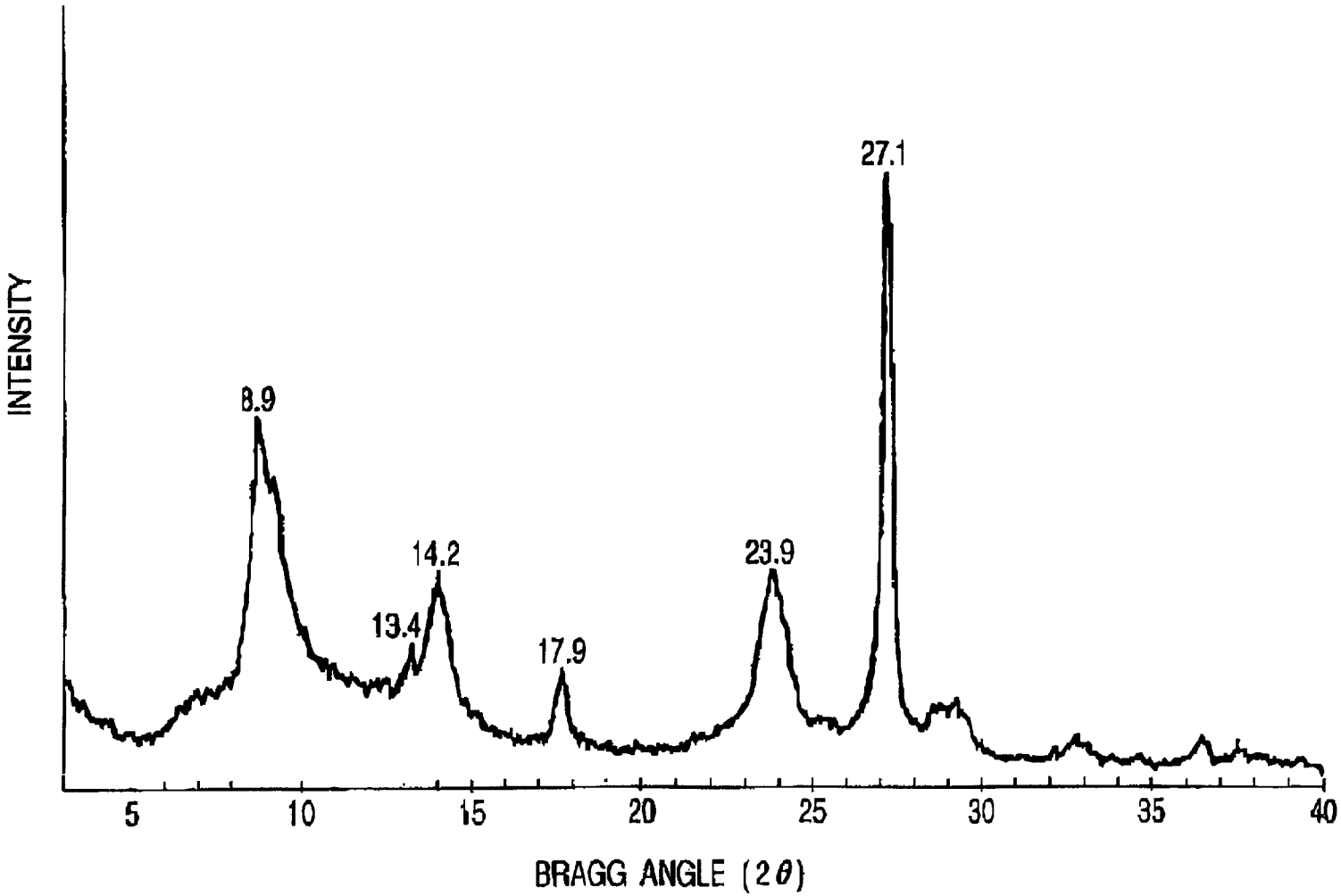
FIG. 4 is a graph showing an X-ray diffraction pattern of oxytitanium phthalocyanine.

Of the oxytitanium phthalocyanine, preferred is oxytitanium phthalocyanine with a crystal form having strong peaks at Bragg's angles (2θ±0.2°) 9.0°, 14.2°, 23.9 ° and 27.1 ° in CuKα characteristic X-ray diffraction as shown in FIG. 4. The above peaks are those picked up from higher-rank four points of strong peak intensities, and show principal peaks.

What is characteristic in the X-ray diffraction pattern shown in FIG. 4 is that, among the four peaks, the peak at 27.1 ° is strongest and the peak at 9.0 ° is next strong. Also, peaks weaker than the above four points are present at the position of 17.9 °, and peaks still weaker than those are present at the position of 13.3 °. There are substantially no peaks in the ranges of from 10.5 ° to 13.0 °, from 14.8 ° to 17.4 ° and from 18.2 ° to 23°.

Incidentally, the shapes of peaks in X-ray diffraction may differ, though slightly, depending on difference in conditions at the time of production and on conditions for measurement. For example, each peak may split at its vertex. In the case of FIG. 4, the hill having a peak at 8.9° has another split peak at about 9.4°, and the hill having a peak at 14.2° has another split peak at about 14.1°.

The oxytitanium phthalocyanine, besides the oxytitanium phthalocyanine with the above crystal form, may also include oxytitanium phthalocyanine with a crystal form having strong peaks at Bragg's angles (2θ±0.2°) 7.6° and 28.6° in CuKα characteristic X-ray diffraction, oxytitanium phthalocyanine with a crystal form having strong peaks at Bragg's angles (2θ±0.2°) 9.6° and 27.3° in CuKα characteristic X-ray diffraction, and oxytitanium phthalocyanine with a crystal form having strong peaks at Bragg's angles (2θ±0.2°) 9.3° and 26.3° in CuKα characteristic X-ray diffraction.

The oxytitanium phthalocyanine has a structure represented by the following Formula (6):

(6)

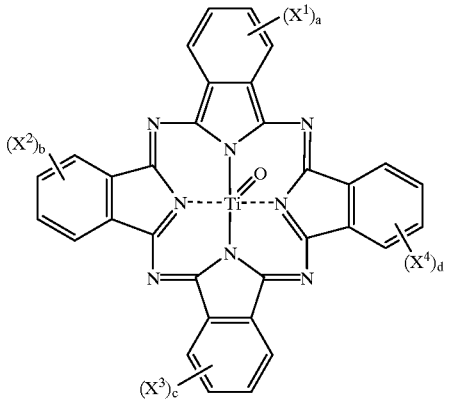

wherein $X^1$, $X^2$, $X^3$ and $X^4$ each independently represent a halogen atom such as chlorine or bromine; and a, b, c and d each independently represent an integer of 0 to 4.

Of the hydroxygallium phthalocyanine, preferred is hydroxygallium phthalocyanine with a crystal form having strong peaks at Bragg's angles (2θ±0.2°) 7.4° and 28.2° in CuKα characteristic X-ray diffract (disclosed in, e.g., Japanese Patent Application Laid-Open No. 5-263007). Of the chlorogallium phthalocyanine, preferred is chlorogallium phthalocyanine with a crystal form having strong peaks at Bragg's angles (2θ±0.2°) 7.40°, 16.6°, 25.5° and 28.2° in CuKα characteristic X-ray diffraction (disclosed in, e.g., Japanese Patent Application Laid-Open No. 5-98181).

The gallium phthalocyanine such as hydroxygallium phthalocyanine or chlorogallium phthalocyanine has a structure represented by the following Formula (7):

(7)

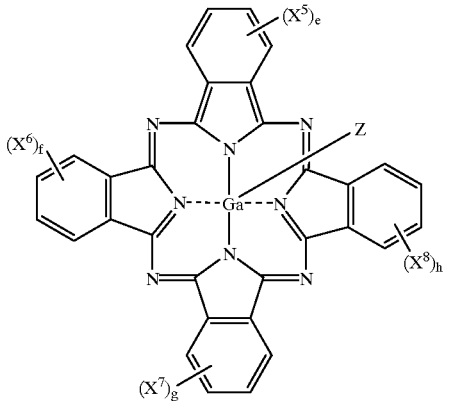

wherein $X^5$, $X^6$, $X^7$ and $X^8$ each independently represent a halogen atom such as chlorine or bromine; e, f, g and h each independently represent an integer of 0 to 4; and Z represent a hydroxyl group or a chlorine atom.

The phthalocyanine pigments, besides the oxytitanium phthalocyanine or the gallium phthalocyanine, may also include dihydroxysilicon phthalocyanine having a structure represented by the following Formula (8) and with a crystal form having strong peaks at Bragg's angles (2θ±0.2°) 7.1°, 9.3°, 12.8°, 15.8°, 17.2°, 25.6° and 26.9° in CuKα characteristic X-ray diffraction (disclosed in, e.g., Japanese Patent Application Laid-Open No. 10-158535); dialkoxysilicon phthalocyanine having a structure represented by the following Formula (9) (disclosed in, e.g., Japanese Patent Application Laid-Open No. 10-237339); and dihydroxysilicon phthalocyanine dimer having a structure represented by the following Formula (10) and with a crystal form having strong peaks at Bragg's angles (2θ±0.2°) 6.9°, 8.0°, 10.6°, 16.0°, 26.3° and 27.4° in CuKα characteristic X-ray diffraction (disclosed in, e.g., Japanese Patent Application Laid-Open No. 10-158534).

(8)

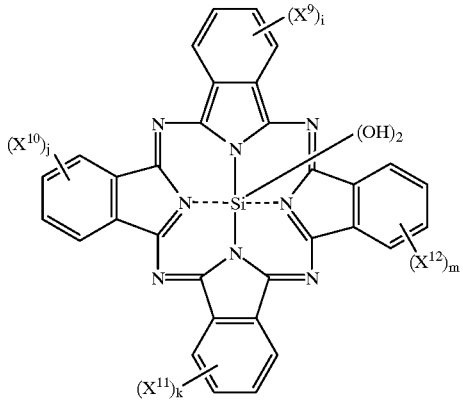

wherein $X^9$, $X^{10}$, $X^{11}$ and $X^{12}$ each independently represent a halogen atom such as chlorine or bromine; and i, j, k and m each independently represent an integer of 0 to 4.

(9)

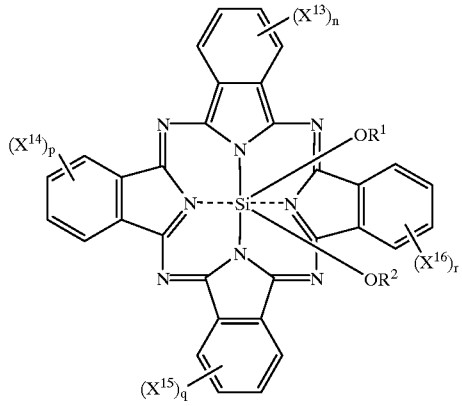

wherein $R^1$ and $R^2$ each represent an alkyl group having 1 to 8 carbon atoms, which may have a substituent, which substituent is a halogen atom such as chlorine or bromine; $X^{13}$, $X^{14}$, $X^{15}$ and $X^{16}$ each independently represent a halogen atom such as chlorine or bromine; and n, p, q and r each independently represent an integer of 0 to 4.

(10)

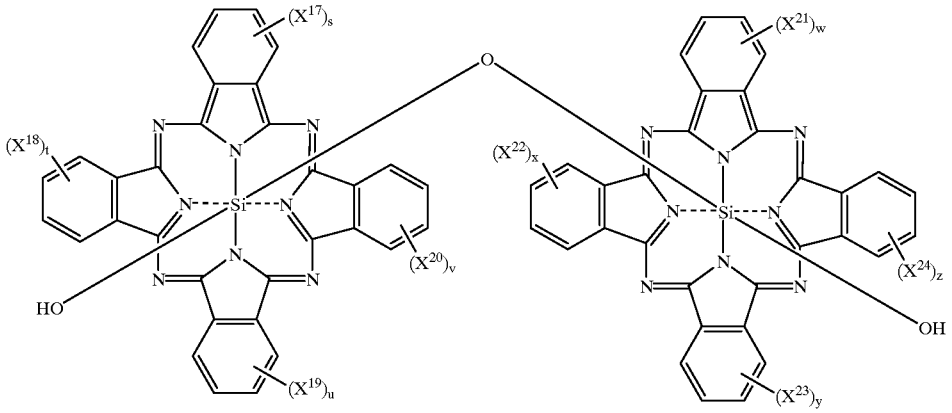

wherein $X^{17}$, $X^{18}$, $X^{19}$, $X^{20}$, $X^{21}$, $X^{22}$, $X^{23}$ and $X^{24}$ each independently represent a halogen atom such as chlorine or bromine; and s, t, u, v, w, x, y and z each independently represent an integer of 0 to 4.

Besides the foregoing phthalocyanines, the phthalocyanine pigment may also include x-type metal-free phthalocyanine.

The phthalocyanine pigment is by no means limited to these.

As a charge-generating material other than the phthalocyanine pigment, also usable in the electrophotographic photosensitive member of the present invention, an azo pigment is preferred. Disazo pigments having a structure represented by the following Formulas (1) to (5) are more preferred.

(1)

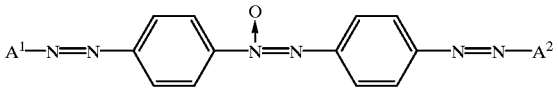

wherein $A^1$ and $A^2$ may be the same or different and each represent an aromatic coupler.

(2)

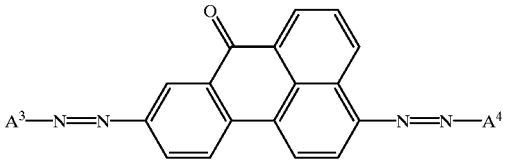

wherein $A^3$ and $A^4$ may be the same or different and each represent an aromatic coupler.

(3)

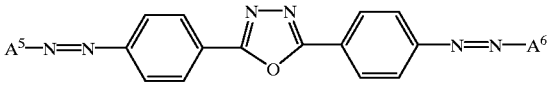

wherein $A^5$ and $A^6$ may be the same or different and each represent aromatic coupler.

(4)

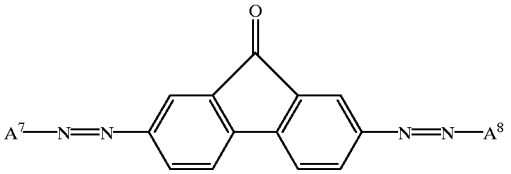

(4)

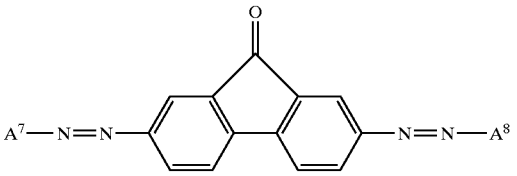

wherein $A^7$ and $A^8$ may be the same or different and each represent an aromatic coupler.

(5)

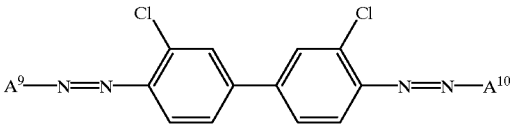

wherein $A^9$ and $A^{10}$ may be the same or different and each represent an aromatic coupler.

$A^1$ to $A^{10}$ each represent an aromatic coupler, and its preferred examples as shown below. Any of the following aromatic couplers may be used, and examples are by no means limited to these.

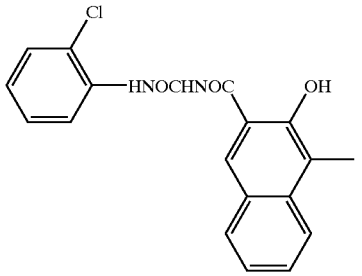

-continued
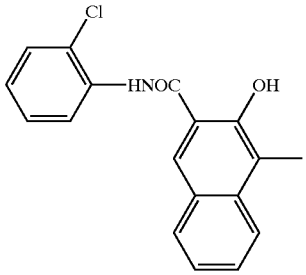
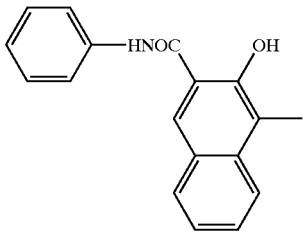
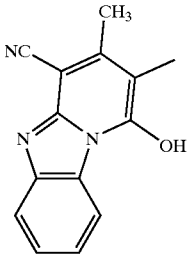
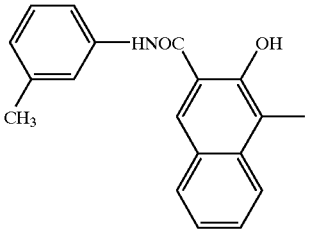
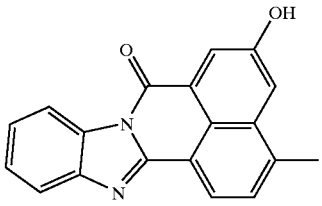
-continued
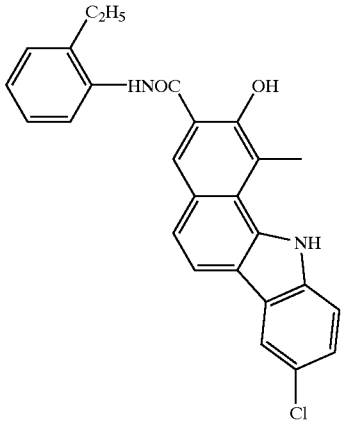
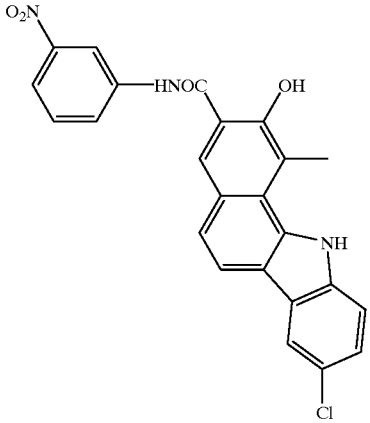
Of the disazo pigment having the structure represented by the above Formula (1), it may include, as a particularly preferred example, a disazo pigment having a structure represented by the following formula:
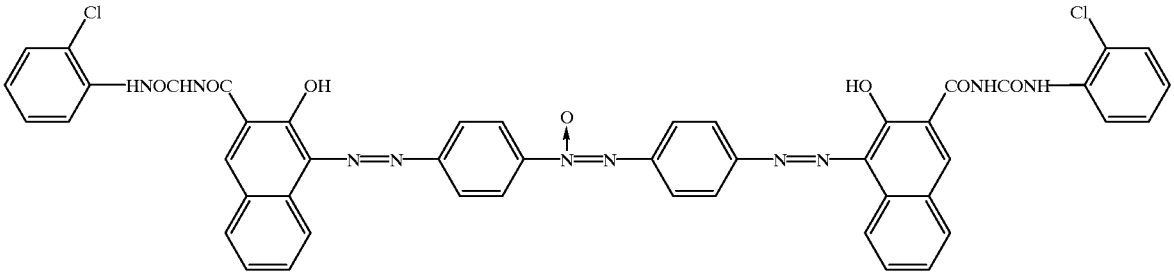

Of the disazo pigment having the structure represented by the above Formula (2), it may include, as a particularly preferred example, a disazo pigment having a structure represented by the following formula:

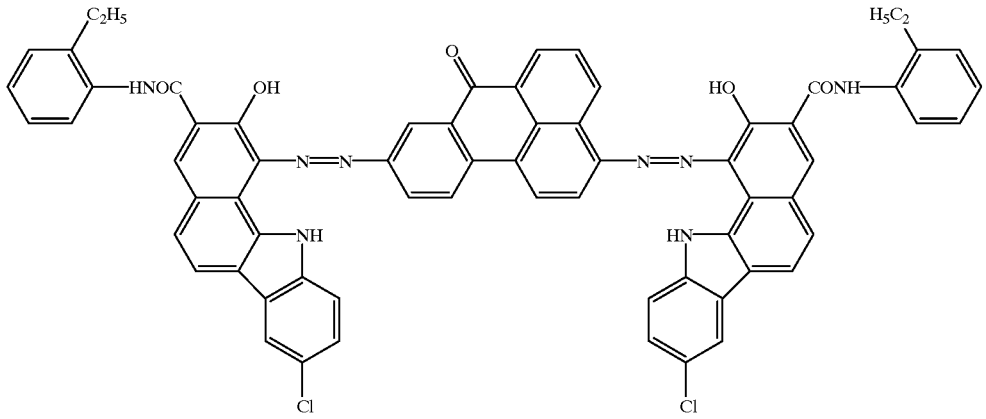

Of the disazo pigment having the structure represented by the above Formula (3), it may include, as a particularly preferred example, a disazo pigment having a structure represented by the following formula:

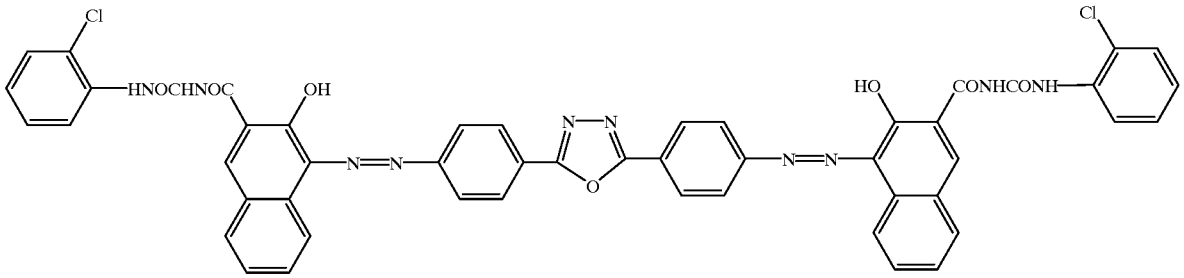

Of the disazo pigment having the structure represented by the above Formula (4), it may include, as a particularly preferred example, a disazo pigment having a structure represented by the following formula:

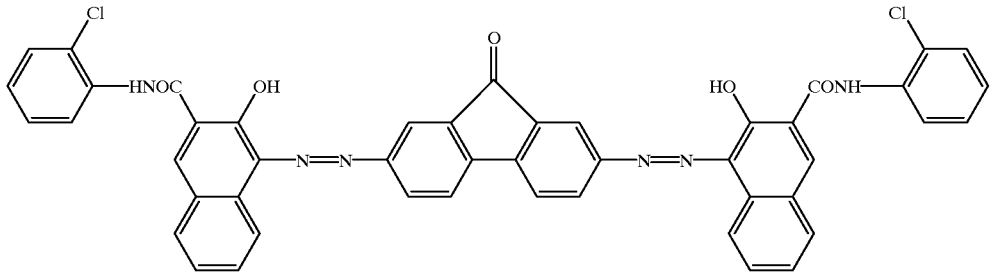

Of the disazo pigment having the structure represented by the above Formula (5), it may include, as a particularly preferred example, a disazo pigment having a structure represented by the following formula:

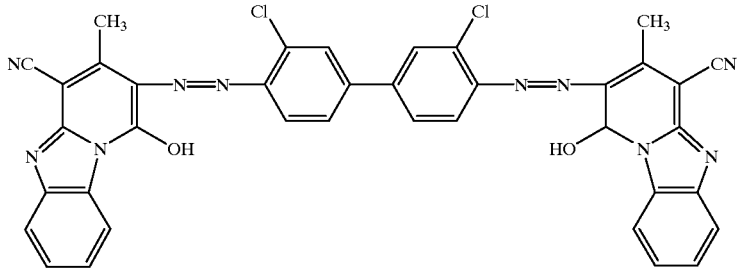

The charge-generating material described above may be used alone or in combination of two or more types. A disazo pigment showing a high sensitivity in the visible-light region and a phthalocyanine pigment having a high sensitivity in the infrared laser region may also be used together.

Incorporation of the charge-generating material pigment in a proportion larger than 2 parts by weight based on 1 part by weight of a binder resin is effective for making a high speed electrophotographic apparatus and a high sensitivity electrophotographic photosensitive member. This is also effective against a negative or positive ghost which is considered to be caused also by electrophotographic processes. However, incorporation of the charge-generating material pigment in a too large proportion tends to cause re-agglomeration of the pigment after it has been dispersed, resulting in poor film properties when the charge generation layer is superposingly formed, to cause faulty images, such as black dots and blank areas. Such film properties are greatly influenced by the surface roughness of the support. In order to provide an electrophotographic photosensitive member that may cause no faulty images, such as black dots and blank areas, the charge-generating material may be in a proportion not larger than 5 parts by weight. That is, in the charge-generating layer of the electrophotographic photosensitive member of the present invention, the charge-generating material must be in an amount of more than 2 parts by weight to not more than 5 parts by weight based on 1 part by weight of a binder resin.

The charge-generating layer may preferably have a thickness of from 0.001 $\mu$m to 5 $\mu$m, and particularly preferably from 0.05 $\mu$m to 2 $\mu$m.

In the present invention, a charge transport layer containing a charge-transporting material is formed on the charge generation layer described above.

The charge-transporting material used in the electrophotographic photosensitive member of the present invention may be selected from, e.g., compounds such as various hydrazones, pyrazolines, oxazole compounds, thiazole compounds, triarylmethane compounds, triallylamine compounds and polyarylalkanes.

The above charge-generating material or charge-transporting material is formed into a film on the support by vacuum deposition, or by coating using a suitable binder resin in combination, to form the charge generation layer or charge transport layer, respectively. The binder resin used when the charge generation layer or charge transport layer is formed by coating may include polyvinyl acetals, polycarbonates, polyarylates, polystyrene, polyesters, polyvinyl acetate, polymethacrylate, acrylic resins and cellulose resins, any of which may preferably be used. In particular, in the charge generation layer, butyral resins or benzal resins of polyvinyl acetals may more preferably be used.

The smaller the layer thickness of the charge transport layer, the higher the electric-field intensity that is applied to the electrophotographic photosensitive member and the more the subbing layer tends to cause insulation breakdown. In the case when the surface-roughened support is used, the insulation breakdown tends to occur at protrusions of the support surface. Where the charge transport layer in the present invention has a layer thickness smaller than 9 $\mu$m, the subbing layer tends to cause insulation breakdown without regard to the surface roughness of the support, tending to cause faulty images, such as black dots and blank areas. Also, where it has a layer thickness of from 9 $\mu$m to 18 $\mu$m, the black dots or blank areas may occur if the support has an Rz larger than 3.0 $\mu$m. However, where the charge transport layer is thicker than 18 $\mu$m, the black dots or blank areas occur less frequently than when it is not thicker than 18 $\mu$m, even if the support has an Rz larger than 3.0 $\mu$m. Still also, where the charge transport layer has a layer thickness larger than 35 $\mu$m, a little poor dot reproducibility may result in the case of digital machines, making it difficult to achieve a higher image quality. However, it is also possible to form the layer to have a smaller thickness where a hardly wearing material is used as the binder resin to be contained in the surface layer charge transport layer or a protective layer. Thus, the formation of the charge transport layer in a larger layer thickness is on the one hand effective for making the electrophotographic photosensitive member have a long lifetime or preventing the black dots or blank areas, but on the other hand tends to sacrifice image quality.

In the present invention, in order to ensure high image quality and at the same time satisfy other requirements, the support is controlled to have the surface roughness described previously, whereby an electrophotographic photosensitive member that does not cause any faulty images can be provided even under the condition that the charge transport layer has a layer thickness of from 9 $\mu$m to 35 $\mu$m or has a smaller layer thickness of from 9 $\mu$m to 18 $\mu$m.

In the electrophotographic photosensitive member of the present invention, a protective layer may be provided on the charge transport layer. The protective layer is chiefly constituted of a resin. The resin material constituting the protective layer may include, e.g., polyesters, polyurethanes, polyacrylates, polyethylenes, polystyrene, polybutadiene, polycarbonates, polyamides, polypropylene, polyimides, polyamide-imides, polysulfone, polyacrylic ethers, polyacetals, phenolic resins, acrylic resins, silicone resins, epoxy resins, urea resins, allyl resins, alkyd resins and butyral resins.

In these resins, in order to improve cleaning performance and wear resistance, a lubricant such as polytetrafluoroethylene, polyvinylidene fluoride, a fluorine-atom-containing graft polymer, a silicon-atom-containing graft polymer or silicone oil may be dispersed. In the sense of resistance control of the protective layer, tin oxide powder or conductive titanium oxide may also be dispersed.

The protective layer may preferably have a layer thickness of from 0.05 μm to 15 μm, and particularly preferably from 1 μm to 10 μm.

In the present invention, a subbing layer may be provided between the support and the charge generation layer in order to, e.g., improve the adherence of the charge generation layer, protect the support, improve the performance of charge injection from the support and protect the electrophotographic photosensitive member from electrical breakdown. The subbing layer may be formed using a material such as polyvinyl alcohol, poly-N-vinylimidazole, polyethylene oxide, ethyl cellulose, methyl cellulose, an ethylene/acrylic acid copolymer, casein, polyamide, copolymer polyamide, glue or gelatin.

A subbing layer may also be used which is formed by a sol-gel process making use of an inorganic polymeric compound. Such a layer may be formed by coating a mixture of zirconium and a silane compound, a mixture of a silane compound and a zirconium compound with a cellulose resin added, or a coating fluid prepared by adding a butyral resin to an inorganic component comprised of zirconium and silane. The subbing layer may preferably have a layer thickness of from 0.01 μm to 5 μm, and particularly preferably from 0.3 μm to 1 μm.

These layers may be formed by a coating method such as dip coating, blade coating, bar coating or spray coating.

Figure 3:
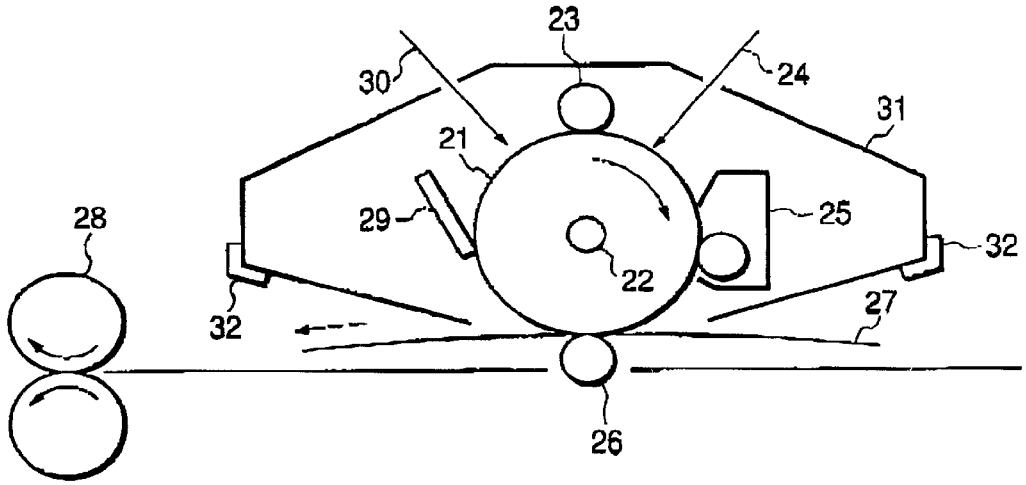
FIG. 3 is a schematic view showing the construction of an electrophotographic apparatus provided with a process cartridge having the electrophotographic photosensitive member of the present invention.

FIG. 3 schematically illustrates the construction of an electrophotographic apparatus provided with a process cartridge having the electrophotographic photosensitive member of the present invention.

In FIG. 3, reference numeral 21 denotes a drum type electrophotographic photosensitive member of the present invention, which is rotatingly driven around an axis 22 in the direction of an arrow at a stated peripheral speed. The electrophotographic photosensitive member 21 is, in the course of its rotation, uniformly electrostatically charged on its periphery to a positive or negative, given potential through a primary charging means 23. The electrophotographic photosensitive member thus charged is then exposed to exposure light 24 emitted from an exposure means (not shown) for slit exposure or laser beam scanning exposure and intensity-modulated correspondingly to time-sequential digital image signals of the intended image information. In this way, electrostatic latent images corresponding to the intended image information are successively formed on the periphery of the electrophotographic photosensitive member 21.

The electrostatic latent images thus formed are subsequently developed by toner by the operation of a developing means 25. The toner images thus formed and held on the surface of the electrophotographic photosensitive member 21 are then successively transferred by the operation of a transfer means 26, to a transfer medium 27 fed from a paper feed section (not shown) to the part between the electrophotographic photosensitive member 21 and the transfer means 26 in the manner synchronized with the rotation of the electrophotographic photosensitive member 21.

The transfer medium 27 on which the images have been transferred is separated from the surface of the electrophotographic photosensitive member, is led through an image fixing means 28, where the images are fixed, and is then printed out of the apparatus as an image-formed material (a print or copy).

The surface of the electrophotographic photosensitive member 21 from which images have been transferred is brought to removal of the toner remaining after the transfer, through a cleaning means 29. Thus the electrophotographic photosensitive member is cleaned on its surface, further subjected to charge elimination by pre-exposure light 30 emitted from a pre-exposure means (not shown), and then repeatedly used for the formation of images. When the primary charging means 23 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 21, primary charging means 23, developing means 25 and a cleaning means 29 so that the process cartridge is detachably mountable to the body of the electrophotographic apparatus such as a copying machine or a laser beam printer. For example, at least one of the primary charging means 23, the developing means 25 and the cleaning means 29 may be integrally supported in a cartridge together with the electrophotographic photosensitive member 21 to form a process cartridge 31 that is detachably mountable to the body of the apparatus through a guide means 32 such as rails provided in the body of the apparatus.

In the case when the electrophotographic apparatus is used as a copying machine or a printer, the exposure light 24 is light reflected from, or transmitted through, an original, or light irradiated by the scanning of a laser beam, the driving of an LED array or the driving of a liquid crystal shatter array according to signals obtained by reading an original through a sensor and converting the information into signals.

The electrophotographic photosensitive member of the present invention may be not only applied in electrophotographic copying machines, but also widely applied in the fields where electrophotography is applied, e.g., laser beam printers, CRT printers, LED printers, facsimile marines, liquid-crystal printers and laser beam engravers.

The present invention is described below in greater detail by giving Examples. The present invention is by no means limited to these Examples. In the following Examples, "part(s)" is meant to be "part(s) by weight".

EXAMPLE 1

An A6063 aluminum crude tube of 30.5 mm in external diameter, 28.5 mm in internal diameter and 260.5 mm in length, obtained by hot-roll extrusion and having a run-out precision of 100 μm and a surface 10-point average roughness Rz of 10 μm was prepared for use.

This crude tube was set on a lathe, and was so cut by means of a diamond sintered turning tool as to have an external diameter of 30.0±0.02 mm, a run-out precision of 15 μm and a surface 10-point average roughness Rz of 0.2 μm. Here, the number of revolutions of the main shaft was 3,000 rpm, the feed rate of the turning tool was 0.3 mm/rev, and the working time was 24 seconds excluding the time for attaching and detaching the workpiece.

The aluminum cut tube thus obtained was subjected to liquid honing by means of the liquid (wet) honing apparatus (manufactured by Fuji Seiki Seizosho) shown in FIG. 1, and under conditions shown below.

Conditions for Liquid Honing

Abrasive grains: Spherical alumina beads of 30 μm in average particle diameter (trade name: CB-A30S; available from Showa Denko K.K.).

Suspending medium: Water.

Abrasive/Suspending medium: 1/9 (volume ratio).

Number of revolutions for aluminum cut tube: 1.67 $s^{-1}$.

Air spray pressure: 0.14 MPa.

Gun movement speed: 13.3 mm/s.

Distance between gun nozzle and aluminum tube: 200 mm.
Honing abrasive grain spray angle: 45°.
Number of honing-liquid jetting times: Once (one way).

After the honing, the resultant cylinder had surface roughness of RmaxD=2.53 μm, Rz=1.3 μm, Ra=0.23 μm and Sm=34 μm.

Next, on this cylinder, a coating fluid prepared by dissolving 10 parts of polyamide resin (trade name: AMILAN CM8000; available from Toray Industries, Inc.) and 30 parts of methoxymethylated 6-nylon resin (trade name: TORESIN EF-30T; available from Teikoku Chemical Industry Co., Ltd.) in 200 parts of a mixed solvent of 400 parts of methanol and 200 parts of n-butanol was dip-coated, followed by hot-air drying at 90° C. for 10 minutes to form a subbing layer with a layer thickness of 0.68 μm.

Next, to a solution prepared by dissolving 3 parts of polyvinyl butyral resin (trade name: S-LEC BX-1; available from Seksui Chemical Co., Ltd.) in 100 parts of cyclohexanone, 6.6 parts of hydroxygallium phthalocyanine having strong peaks at Bragg's angles (2θ±0.2°) 7.4° and 28.2° in CuKα characteristic X-ray diffraction was added. The mixture obtained was dispersed for 6 hours by means of a sand mill making use of glass beads of 1 mm diameter. To the dispersion thus obtained, 100 parts of ethyl acetate was added to make up a charge generation layer coating dispersion. This dispersion was dip-coated on the subbing layer, followed by drying at 100° C. for 10 minutes to form a charge generation layer with a layer thickness of 0.25 μm.

Next, 9 parts of an amine compound of the following structural formula:

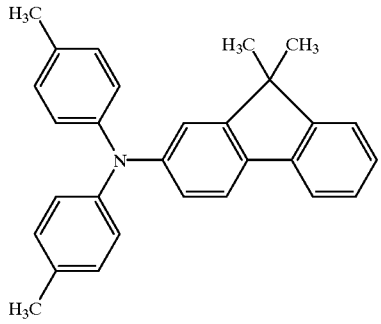

1 part of an amine compound of the following structural formula:

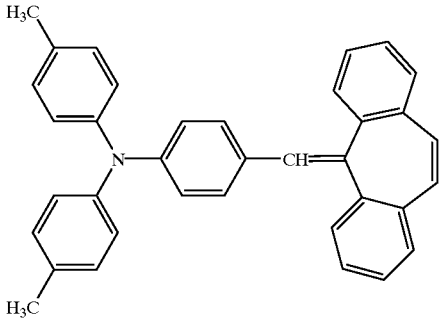

and 10 parts of bisphenol-Z polycarbonate resin (trade name: IUPILON Z-200; available from Mitsubishi Gas Chemical Company, Inc.) were dissolved in a mixed solvent of 70 parts of monochlorobenzene and 30 parts of dichloromethane to make up a coating fluid. This coating fluid was coated on the charge generation layer by dipping, followed by drying at 120° C. for 1 hour to form a charge transport layer with a layer thickness of 17 μm.

The electrophotographic photosensitive member thus produced was set in a printer LASER JET 4000, manufactured by Hewlett-Packard Co., having been so remodeled that the amount of light and the setting of charging were variable, and images were reproduced to make evaluation.

Image evaluation on black dots was made by the number and size of defects on white images corresponding to one round of the drum, according to the following criteria.

A: No black dot at all.

A⁻: Back dots smaller than 1.5 mm in diameter are not more than 5, or black dots of 1.5 mm or larger in diameter are not more than 2.

B: Black dots smaller than 1.5 mm in diameter are not more than 9, or black dots of 1.5 mm or larger in diameter are not more than 4.

C: Black dots smaller than 1.5 mm in diameter are 10 or more, or black dots of 1.5 mm or larger in diameter are 5 or more.

Evaluation of interference fringes was made by image evaluation, according to the following criteria.

A: No interference fringes were seen at all.

C: Interference fringes were seen.

Evaluation of ghost images was made using a halftone test chart in which square solid black areas of 25 mm×25 mm were arranged in an area corresponding to one round of the electrophotographic photosensitive member. After the halftone test chart was printed once, in the second and subsequent rounds of the electrophotographic photosensitive member, a pattern having the square solid black areas at positions corresponding to knight jumps was printed. Image evaluation of the ghost images was made according to the following criteria.

A: No ghost was seen at all.

A⁻: Ghost was little seen.

B: Slight ghost was seen.

C: Ghost was clearly seen.

In the above evaluation criteria, "C" was judged that the effect of the present invention was not well attained.

The results of evaluation are shown in Table 1.

EXAMPLE 2

An electrophotographic photosensitive member was produced in the same manner as in Example 1 except that the hydroxygallium phthalocyanine pigment of the coating fluid for the charge generation layer was added in an amount of 15 parts to obtain a product of Example 2. Evaluation was made in the same manner as in Example 1 to obtain the results shown in Table 1.

EXAMPLES 3 AND 4

Electrophotographic photosensitive members were produced in the same manner as in Examples 1 and 2, respectively, except that in the wet honing the air spray pressure was changed to 0.22 MPa to obtain products of Examples 3 and 4. Evaluation was made in the same manner as in Example 1 to obtain the results shown in Table 1.

After the honing, the resultant cylinders each had surface roughness of RmaxD=2.75 μm, Rz=2.0 μm, Ra=0.24 μm and Sm=31 μm.

COMPARATIVE EXAMPLES 1 AND 2

Electrophotographic photosensitive members were produced in the same manner as in Examples 1 and 2, respectively, except that in the wet honing the air spray pressure was charged to 0.13 MPa to obtain products of Comparative, Examples 1 and 2. Evaluation was made in the same manner as in Example 1 to obtain the results shown in Table 1.

After the honing, resultant cylinders each had surface roughness of RmaxD=2.25 μm, Rz=1.1 μm, Ra=0.22 μm and Sm=39 μm.

EXAMPLES 5 AND 6

Electrophotographic photosensitive members were produced in the same manner as in Examples 1 and 2, respectively, except that in the wet honing the air spray pressure was changed to 0.25 MPa to obtain products of Examples 5 and 6. Evaluation was made in the same manner as in Example 1 to obtain the results shown in Table 1.

After the honing, the resultant cylinders each had surface roughness of RmaxD=3.65 μm, Rz=2.2 μm, Ra=0.25 μm and Sm=36 μm.

EXAMPLES 7 AND 8

Electrophotographic photosensitive members were produced in the same manner as in Examples 1 and 2, respectively, except that in the liquid honing the abrasive was changed from alumina beads to stainless-steel beads and the liquid-honing conditions were changed as shown below, to obtain products of Examples 7 and 8. Evaluation was made in the same manner as in Example 1 to obtain the results shown in Table 1.

Conditions for Liquid Honing

Abrasive grains: Stainless steel beads of 50 to 150 μm in particle diameter (trade name: BPS150(SUS304 ): available from Itoh Kiko K.K.).

Suspending medium: Water.

Abrasive/Suspending medium: 1/9 (volume ratio).

Number of revolutions for aluminum cut tube: 1.67 $s^{-1}$.

Air spray pressure: 0.06 MPa.

Gun movement speed: 13.3 mm/s.

Distance between gun nozzle and aluminum tube: 200 mm.

Honing abrasive grain spray angle: 45°.

Number of honing-liquid jetting times: Once (one way).

After the honing, the resultant cylinder had surface roughness of RmaxD=2.56 μm, Rz=1.3 μm, Ra=0.21 μm and Sm=35 μm.

EXAMPLES 9 AND 10

Electrophotographic photosensitive members were produced in the same manner as in Examples 7 and 8, respectively, except that in the wet honing the air spray pressure was changed to 0.10 MPa to obtain products of Examples 9 and 10. Evaluation was made in the same manner as Example 1 to obtain the results shown in Table 1.

After the honing, the resultant cylinders each had surface roughness of RmaxD=2.27 μm, Rz=2.0 μm, Ra=0.24 μm and Sm=31 μm.

COMPARATIVE EXAMPLES 3 AND 4

Electrophotographic photosensitive members were produced in the same manner as in Examples 7 and 8, respectively, except that in the wet honing the air spray pressure was changed to 0.04 MPa to obtain products of Comparative Examples 3 and 4. Evaluation was made in the same manner as in Example 1 to obtain the results shown in Table 1.

After the honing, the resultant cylinders each had surface roughness of RmaxD=2.75 μm, Rz=1.1 μm, Ra=0.2 μm and Sm=39 μm.

EXAMPLES 11 AND 12

Electrophotographic photosensitive members were produced in the same manner as in Examples 7 and 8, respectively, except that in the wet honing the air spray pressure was changed to 0.12 MPa to obtain products of Examples 11 and 12. Evaluation was made in the same manner as in Example 1 to obtain the results shown in Table 1.

After the honing, the resultant cylinders each had surface roughness of RmaxD=3.55 μm, Rz=2.2 μm, Ra=0.25 μm and Sm=27 μm.

EXAMPLES 13, 15, 17, 19, 21 AND 23

To form a charge generation layer, a mixture comprised of 4.4 parts of oxytitanium phthalocyanine having strong peaks at Bragg's angles (2θ±0.2°) 9.0°, 14.2°, 23.9° and 27.1° in CuKα characteristic X-ray diffraction, 2 parts of polyvinyl butyral resin (trade name: S-LEC BX-1: available from Sekisui Chemical Co., Ltd.) and 60 parts of cyclohexanone was dispersed for 4 hours by means of a sand mill making use of glass beads of 1 diameter, followed by addition of 100 parts of ethyl acetate to make up a charge generation layer coating dispersion. Electrophotographic photosensitive members were produced in the same manner as in Examples 1, 3, 5, 7, 9 and 11, respectively, except that this dispersion was dip-coated on each subbing layer, followed by drying at 95° C. for 10 minutes to form charge generation layers with a layer thickness of 0.3 μm each to obtain products of Examples 13, 15, 17, 19, 21 and 23. Evaluation was made in the same manner as in Example 1 to obtain the results shown in Table 1.

EXAMPLES 14, 16, 18, 20, 22 AND 24

Electrophotographic photosensitive members were produced in the same manner as in Examples 13, 15, 17, 19, 21 and 23, respectively, except that the oxytitanium phthalocyanine pigment of the coating fluid for the charge generation layer was added in an amount of 10 parts to obtain products of Examples 14, 16, 18, 20, 22 and 24. Evaluation was made in the same manner as in Example 1 to obtain the results shown in Table 1.

COMPARATIVE EXAMPLES 5 AND 7

To form a charge generation layer, a mixture comprised of 4.4 parts of oxytitanium phthalocyanine having strong peaks at Bragg's angles (2θ±0.2°) 9.0°, 14.2°, 23.9° and 27.1° in CuKα characteristic X-ray diffraction, 2 parts of polyvinyl butyral resin (trade name: S-LEC BX-1; available from Sekisui Chemical Co., Ltd.) and 60 parts of cyclohexanone was dispersed for 4 hours by means of a sand mill making use of glass beads of 1 mm diameter, followed by addition of 100 parts of ethyl acetate to make up a charge generation layer coating dispersion. Electrophotographic photosensitive members were produced in the same manner as in Comparative Examples 1 and 3, respectively, except that this dispersion was dip-coated on each subbing layer, followed by drying at 95° C. for 10 minutes to form charge generation layers with a layer thickness of 0.3 μm each to obtain products of Comparative Examples 5 and 7. Evaluation was made in the same manner as in Example 1 to obtain the results shown in Table 1.

COMPARATIVE EXAMPLES 6 AND 8

Electrophotographic photosensitive members were produced in the same manner as in Comparative Examples 5 and 7, respectively, except that the oxytitanium phthalocyanine pigment of the coating fluid for the charge generation layer was added in an amount of 10 parts to obtain products of Comparative Examples 6 and 8. Evaluation was made in the same manner as in Example 1 to obtain the results shown in Table 1.

EXAMPLES 25, 26, 31 AND 32

An A3003 aluminum cylinder (ED tube) of 30.0 mm in external diameter, 28.5 mm in internal diameter and 260.5 mm in length, having a surface 10-point average roughness Rz of 1.2 μm was prepared for use.

Electrophotographic photosensitive members were produced in the same manner as in Examples 1, 2, 13 and 14, respectively, except that the aluminum cylinder (ED tube) thus prepared was subjected to liquid honing by means of the liquid (wet) honing apparatus (manufactured by Fuji Seski Seizosho) shown in FIG. 1, to obtain products of Examples 25, 26, 31 and 32. Evaluation was made the same manner as in Example 1 to obtain the results shown in Table 1.

After the honing, the resultant cylinders each had surface roughness of RmaxD=2.60 μm, Rz=1.3 μm, Ra=0.24 μm and Sm=36 μm.

EXAMPLES 27, 28, 33 AND 34

An A3003 aluminum cylinder (ED tube) of 30.0 mm in external diameter, 28.5 mm in internal diameter and 260.5 mm in length, having a surface 10-point average roughness Rz of 1.2 μm was prepared for use.

Electrophotographic photosensitive members were produced in the sane manner as in Examples 3, 4, 15 and 16, respectively, except that the aluminum cylinder (ED tube) thus prepared was subjected to liquid honing by means of the liquid (wet) honing apparatus (manufactured by Fuji Seiki Seizosho) shown in FIG. 1, to obtain products of Examples 27, 28, 33 and 34. Evaluation was made in the same manner as in Example 1 to obtain the results shown in Table 1.

After the honing, the resultant cylinders each had surface roughness of RmaxD=3.35 μm, Rz=2.0 μm, Ra=0.27 μm and Sm=31 μm.

COMPARATIVE EXAMPLES 9, 10, 11 AND 12

An A3003 aluminum cylinder (ED tube) of 30.0 mm in external diameter, 28.5 mm in internal diameter and 260.5 mm in length, having a surface 10-point average roughness Rz of 1.2 μm was prepared for use.

Electrophotographic photosensitive members were produced in the same manner as in Comparative Examples 1, 2, 5 and 6, respectively, except that the aluminum cylinder (ED tube) thus prepared was subjected to liquid honing by means of the liquid (wet) honing apparatus (manufactured by Fuji Seiki Seizosho) shown in FIG. 1, to obtain products of Comparative Examples 9, 10, 11 and 12. Evaluation was made in the same manner as in Example 1 to obtain the results shown in Table 1.

After the honing, the resultant cylinders each had surface roughness of RmaxD=2.27 μm, Rz=1.1 μm, Ra=0.21 μm and Sm=40 μm.

EXAMPLES 29, 30, 35 AND 36

An A3003 aluminum cylinder (ED tube) of 30.0 mm in external diameter, 28.5 mm in internal diameter and 260.5 mm in length, having a surface 10-point average roughness Rz of 1.2 μm was prepared for use.

Electrophotographic photosensitive members were produced in the same manner as in Examples 5, 6, 17 and 18, respectively, except that the aluminum cylinder (ED tube) thus prepared was subjected to liquid honing by means of the liquid (wet) honing apparatus (manufactured by Fuji Seiki Seizosho) shown in FIG. 1, to obtain products of Examples 29, 30, 35 and 36. Evaluation was made in the same manner as in Example 1 to obtain the results shown in Table 1.

After the honing, the resultant cylinders each had surface roughness of RmaxD=3.68 μm, Rz=2.2 μm, Ra=0.28 μm and Sm=36 μm.

COMPARATIVE EXAMPLE 13

An electrophotographic photosensitive member was produced in the same manner as in Example 1 except that in the wet honing the air spray pressure was changed to 0.12 MPa to obtain a product of Comparative Example 13. Evaluation was made in the same manner as in Example 1 to obtain the results shown in Table 1.

After the honing, the resultant cylinder had surface roughness of RmaxD=2.21 μm, Rz=0.9 μm, Ra=0.14 μm and Sm=43 μm.

COMPARATIVE EXAMPLE 14

An electrophotographic photosensitive member was produced in the same manner as in Example 1 except that in the wet honing the air spray pressure was changed to 0.03 MPa to obtain a product of Comparative Example 14. Evaluation was made in the same manner as in Example 1 to obtain the results shown in Table 1.

After the honing, the resultant cylinder had surface roughness of RmaxD=2.59 μm, Rz=0.9 μm, Ra=0.19 μm and Sm=81 μm.

EXAMPLE 37

An electrophotographic photosensitive member was produced in the same manner as in Example 13 except that oxytitanium phthalocyanine having strong peaks at Bragg's angles (2θ±0.2°) 7.6° and 28.6° in CuKα characteristic X-ray diffraction was used in the charge generation layer to obtain a product of Example 37. Evaluation was made in the same manner as in Example 1 to obtain the results shown in Table 1.

EXAMPLE 38

An electrophotographic photosensitive member was produced in the same manner as in Example 13 except that oxytitanium phthalocyanine having strong peaks at Bragg's angles (2θ±0.2°) 9.6° and 27.3° in CuKα characteristic X-ray diffraction was used in the charge generation layer to obtain a product of Example 38. Evaluation was made in the same manner as Example 1 to obtain the results shown in Table 1.

EXAMPLE 39

An electrophotographic photosensitive member was produced in the same manner as in Example 13 except that oxytitanium phthalocyanine having strong peaks at Bragg's angles (2θ±0.2°) 9.3° and 26.3° in CuKα characteristic X-ray diffraction was used in the charge generation layer to obtain a product of Example 39. Evaluation was made in the same manner as in Example 1 to obtain the results shown in Table 1.

EXAMPLE 40

An electrophotographic photosensitive member was produced in the same manner as in Example 1 except that chlorogallium phthalocyanine having strong peaks at Bragg's angles (2θ±0.2°) 7.4°, 16.6°, 25.5° and 28.2° in CuKα characteristic x-ray diffraction was used in the charge generation layer to obtain a product of Example 40. Evaluation was made in the same manner as in Example 1 to obtain the results shown n Table 1.

EXAMPLE 41

To form a charge generation layer, a mixture comprised of 4.4 parts of dihydroxysilicon phthalocyanine having strong peaks at Bragg's angles (2θ±0.2°) 7.1°, 9.3°, 12.8°, 15.8°, 17.2°, 25.6 and 26.9° in CuKα characteristic X-ray diffraction, 2 parts of polyvinyl butyral resin (trade name: S-LEC BX-1; available from Sekisui Chemical Co., Ltd.) and 100 parts of cyclohexanone was dispersed for 3 hours by means of a sand mill making use of glass beads of 1 mm diameter, followed by addition of 100 parts of ethyl acetate to make up a charge generation layer coating dispersion. An electrophotographic photosensitive member was produced in the same manner as in Example 1 except that this dispersion was dip-coated on the subbing layer, followed by drying at 80° C. for 10 minutes to form a charge generation layer with a layer thickness of 0.3 μm to obtain a product of Example 41. Evaluation was made in the same manner as in Example 1 to obtain the results shown in Table 1.

EXAMPLE 42

An electrophotographic photosensitive member was produced in the same manner as in Example 41 except that dimethoxysilicon phthalocyanine having strong peaks at Bragg's angles (2θ±0.2°) 8.1°, 12.2°, 13.0°, 17.0°, 18.7°, 23.3°, 26.0°, 27.8° and 30.4° in CuKα characteristic X-ray diffraction was used in the charge generation layer to obtain a product of Example 42. Evaluation was made in the same manner as in Example 1 to obtain the results shown in Table 1.

EXAMPLE 43

An electrophotographic photosensitive member was produced in the same manner as in Example 41 except that dihydroxysilicon phthalocyanine dimer having strong peaks at Bragg's angles (2θ±0.2°) 6.9°, 8.0°, 10.6°, 16.0°, 26.3° and 27.4° in CuKα characteristic X-ray diffraction was used in the charge generation layer to obtain a product of Example 43. Evaluation was made in the same manner as in Example 1 to obtain the results shown in Table 1.

EXAMPLE 44

An electrophotographic photosensitive member was produced in the same manner as in Example 1 except that x-type metal-free phthalocyanine was used in the charge generation layer to obtain a product of Example 44. Evaluation was made in the same manner as in Example 1 to obtain the results shown in Table 1.

EXAMPLE 45

To form a charge generation layer, to a solution prepared by dissolving 4 parts of polyvinyl butyral resin (trade name: S-LEC BX-1; available from Sekisui Chemical Co., Ltd.) in 100 parts of cyclohexanone, 1.1 parts of oxytitanium phthalocyanine having strong peaks at Bragg's angles (2θ±0.2°) 9.0°, 14.2°, 23.9° and 27.1° in CuKα characteristic X-ray diffraction and 7.7 parts of a disazo pigment having the following structure:

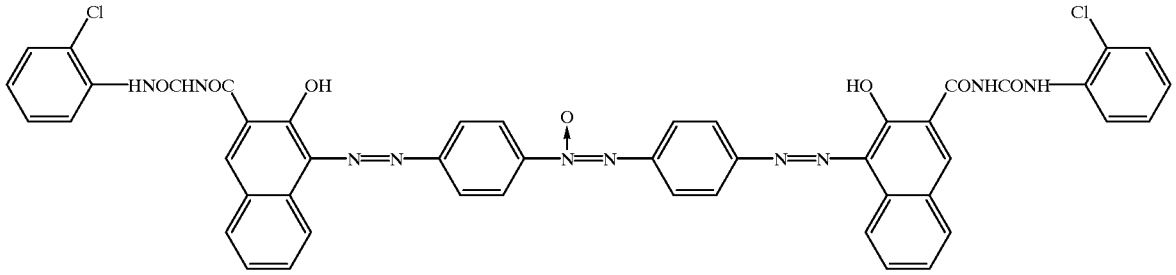

were added. The mixture obtained was dispersed for 3 hours by means of sand mill making use of glass beads of 1 mm diameter. To the dispersion thus obtained, 100 parts of ethyl acetate was added to dilute the dispersion, which was collected thereafter, to make up a charge generation layer coating dispersion. An electrophotographic photosensitive member was produced in the same manner as in Example 1 except that this dispersion was coated on the subbing layer, followed by drying at 80° C. for 10 minutes to form a charge generation layer with a layer thickness of 0.25 μm to obtain a product of Example 45. Evaluation was made in the same manner as in Example 1 to obtain the results shows in Table 1.

EXAMPLE 46

To form a charge generation layer, 4.4 parts of a disazo pigment having a structure represented by the following formula:

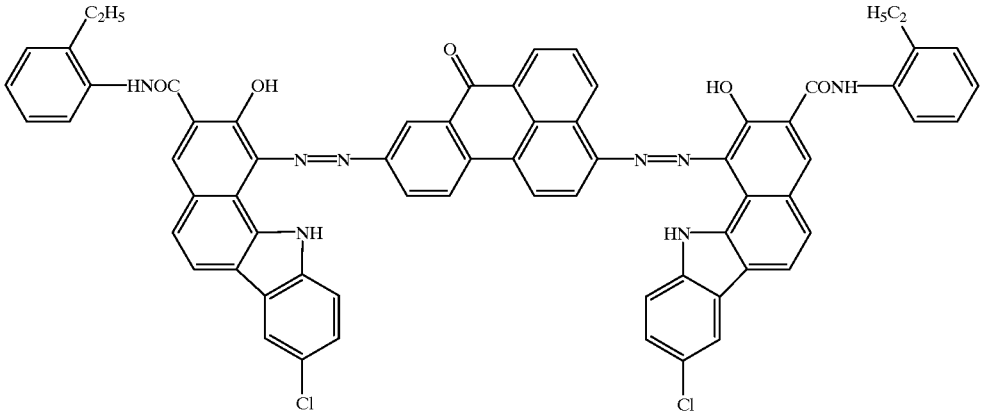

2 parts of polyvinyl butyral resin (trade name: S-LEC BLS; available from Sekisui Chemical Co., Ltd.) and 35 parts of cyclohexanone were dispersed for 12 hours by means of a sand mill making use of glass beads of 1 mm diameter, followed by addition of 60 parts of methyl ethyl ketone to make up a charge generation layer coating dispersion. An electrophotographic photosensitive member was produced in the same manner as in Example 1 except that this dispersion was coated on the subbing layer by dip coating, followed by drying to form a charge generation layer with a layer thickness of 0.3 $\mu$m to obtain a product of Example 46. Evaluation was made in the same manner as in Example 1 to obtain the results shown in Table 1.

EXAMPLE 47

An electrophotographic photosensitive member was produced in the same manner as in Example 46 except that 4.4 parts of a disazo pigment having a structure represented by the following formula:

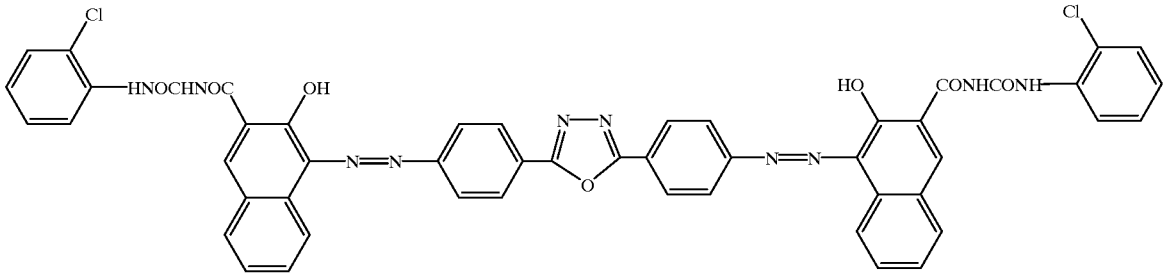

was used in the charge generation layer to obtain a product of Example 47. Evaluation was made in the same manner as in Example 1 to obtain the results shown in Table 1.

EXAMPLE 48

An electrophotographic photosensitive member was produced in the same manner as in Example 46 except that 4.4 parts of a disazo pigment having a structure represented by the following formula:

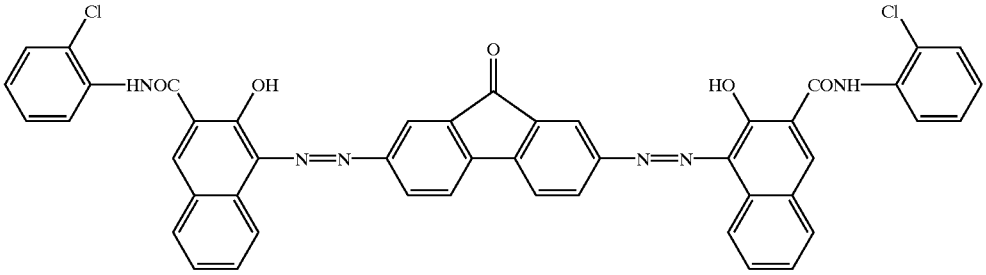

was used in the charge generation layer to obtain a product of Example 48. Evaluation was made in the same manner as in Example 1 to obtain the results shown in Table 1.

EXAMPLE 49

An electrophotographic photosensitive member was produced in the same manner as in Example 46 except that 4.4 parts of a disazo pigment having a structure represented by the following formula:

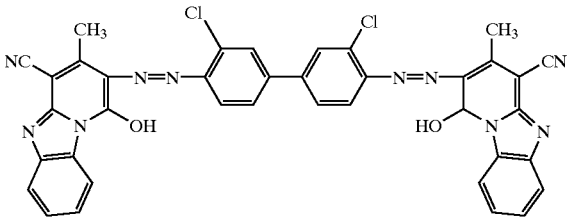

was used in the charge generation layer to obtain a product of Example 49. Evaluation was made in the same manner as in Example 1 to obtain the results shown in Table 1.

EXAMPLE 50

An electrophotographic photosensitive member was produced in the same manner as in Example 1 except that in the wet honing the air spray pressure was changed to 0.26 MPa to obtain a product of Example 50. Evaluation was made in the same manner as in Example 1 to obtain the results shown in Table 1.

After the honing, the resultant cylinder had surface roughness of RmaxD=3.75 $\mu$m, Rz=2.25 $\mu$m, Ra=0.31 $\mu$m and Sm=31 $\mu$m.

EXAMPLE 51

An electrophotographic photosensitive member was produced in the same manner as in Example 7 except that in the wet honing the air spray pressure was changed to 0.22 MPa to obtain a product of Example 51. Evaluation was made in the same manner as in Example 1 to obtain the results shown in Table 1.

After the honing, the resultant cylinder had surface roughness of RmaxD=4.75 $\mu$m, Rz=2.00 $\mu$m, Ra=0.23 $\mu$m and Sm=32 $\mu$m.

EXAMPLES 52 TO 59

Electrophotographic photosensitive members were produced in the same manner as in Examples 1 to 4 and 13 to 16, respectively, except that the charge transport layers were each formed in a layer thickness of 9 $\mu$m to obtain products of Examples 52 to 59. Evaluation was made in the same manner as in Example 1 to obtain the results shown in Table 1.

EXAMPLES 60 TO 63

Electrophotographic photosensitive members were produced in the same manner as in Examples 5, 6, 17 and 18, respectively, except that the charge transport layers were each formed in a layer thickness of 9 $\mu$m to obtain products of Examples 60 to 63. Evaluation was made in the same manner as in Example 1 to obtain the results shown in Table 1.

EXAMPLES 64 TO 71

Electrophotographic photosensitive members were produced in the same manner as in Examples 1 to 4 and 13 to 16, respectively, except that the charge transport layers were each formed in a layer thickness of 18 $\mu$m to obtain products of Examples 64 to 71. Evaluation was made in the sane manner as in Example 1 to obtain the results shown in Table 1.

EXAMPLES 72 to 75

Electrophotographic photosensitive members were produced in the same manner as in Examples 5, 6, 17 and 18, respectively, except that the charge transport layers were each formed in a layer thickness of 18 $\mu$m to obtain products of Examples 72 to 75. Evaluation was made in the same manner as in Example 1 to obtain the results shown in Table 1.

EXAMPLES 76 TO 83

Electrophotographic photosensitive members were produced in the same manner as in Examples 1 to 4 and 13 to 16, respectively, except that the charge transport layers were each formed in a layer thickness of 35 $\mu$m to obtain products of Examples 76 to 83. Evaluation was made in the same manner as in Example 1 to obtain the results shown in Table 1.

COMPARATIVE EXAMPLES 15 AND 16

Electrophotographic photosensitive members were produced in the same manner as in Examples 1 and 2, respectively, except that in the wet honing the air spray pressure was changed to 0.05 MPa to obtain products of Comparative Examples 15 and 16. Evaluation was made in the same manner as in Example 1 to obtain the results shown in Table 1.

After the honing, the resultant cylinders each had surface roughness of RmaxD=1.1 μm, Rz=0.9 μm, Ra=0.15 μm and Sm=48 μm.

EXAMPLES 84 AND 85

Electrophotographic photosensitive members were produced in the same manner as in Examples 1 and 2, respectively, except that in the wet honing the air spray pressure was changed to 0.21 MPa to obtain products of Examples 84 and 85. Evaluation was made in the same manner as in Example 1 to obtain the results shown in Table 1.

After the honing, the resultant cylinders each had surface roughness of RmaxD=4.5 μm, Rz=1.9 μm, Ra=0.25 μm and Sm=37 μm.

EXAMPLES 86 AND 87

Electrophotographic photosensitive members were produced in the same manner as in Examples 1 and 2, respectively, except that in the wet honing the air spray pressure was changed to 0.24 MPa to obtain products of Examples 86 and 87. Evaluation was made in the same manner as in Example 1 to obtain the results shown in Table 1.

After the honing, the resultant cylinders each had surface roughness of RmaxD=5.0 μm, Rz=2.0 μm, Ra=0.26 μm and Sm=36 μm.

COMPARATIVE EXAMPLES 17 AND 18

Electrophotographic photosensitive members were produced in the same manner as in Examples 1 and 2, respectively, except that in the wet honing the air spray pressure was changed to 0.23 MPa to obtain products of Comparative Examples 17 and 18. Evaluation was made in the same manner as in Example 1 to obtain the results shown in Table 1.

After the honing, the resultant cylinders each had surface roughness of RmaxD=5.1 μm, Rz=1.9 μm, Ra=0.25 μm and Sm=38 μm.

EXAMPLES 88 AND 89

Electrophotographic photosensitive members were produced in the same manner as in Examples 1 and 2, respectively, except that in the wet honing method spherical alumina beads of 50 μm, in average particle diameter (trade name: CB-50A; available from Showa Denko K.K.) were used as the abrasive grains, the air spray pressure was changed to 0.15 MPa, the honing abrasive grain spray angle was changed to 90°, and the distance between the gun nozzle and the aluminum tube was changed to 120 mm to obtain products of Examples 88 and 89. Evaluation was made in the same manner as in Example 1 to obtain the results shown in Table 1.

After the honing, the resultant cylinders each had surface roughness of RmaxD=2.0 μm, Rz=1.2 μm, Ra=0.19 μm and Sm=80 μm.

EXAMPLES 90 AND 91

Electrophotographic photosensitive members were produced in the same manner as in Examples 1 and 2, respectively, except that in the wet honing method the air spray pressure was changed to 0.24 MPa, the honing abrasive grain spray angle was changed to 90°, and the distance between the gun nozzle and the aluminum tube was changed to 180 mm to obtain products of Examples 90 and 91. Evaluation was made in the same manner as in Example ito obtain the results shown in Table 1.

After the honing, the resultant cylinders each had surface roughness of RmaxD=4.4 μm, Rz=3.0 μm, Ra=0.29 μm and Sm=34 μm.

COMPARATIVE EXAMPLES 19 AND 20

Electrophotographic photosensitive members were produced in the same manner as in Examples 90 and 91, respectively, except that in the wet honing the air spray pressure was changed to 0.25 MPa to obtain products of Comparative Examples 19 and 20. Evaluation was made in the same manner as in Example 1 to obtain the results shown in Table 1.

After the honing, the resultant cylinders each had surface roughness of RmaxD=4.4 μm, Rz=3.1 μm, Ra=0.3 μm and Sm=33 μm.

COMPARATIVE EXAMPLES 21 AND 22

Electrophotographic photosensitive members were produced in the same manner as in Examples 1 and 2, respectively, except that in the wet honing the air spray pressure was changed to 0.15 MPa to obtain products of Comparative Examples 21 and 22. Evaluation was made in the same manner as in Example 1 to obtain the results shown in Table 1.

After the honing, the resultant cylinders each had surface roughness of RmaxD=2.4 μm, Rz=1.2 μm, Ra=0.14 μm and Sm=42 μm.

EXAMPLES 92 AND 93

Electrophotographic photosensitive members were produced in the same manner as in Examples 1 and 2, respectively, except that in the wet honing method the air spray pressure was changed to 0.15 MPa and the distance between the gun nozzle and the aluminum tube was changed to 170 mm to obtain products of Examples 92 and 93. Evaluation was made in the same manner as in Example 1 to obtain the results shown in Table 1.

After the honing, the resultant cylinders each had surface roughness of RmaxD=2.0 μm, Rz=1.3 μm, Ra=0.15 μm and Sm=41 μm.

EXAMPLES 94 AND 95

Electrophotographic photosensitive members were produced in the same manner as in Examples 1 and 2, respectively, except that in the wet honing method the air spray pressure was changed to 0.16 MPa and the distance between the gun nozzle and the aluminum tube was changed to 160 mm to obtain products of Examples 94 and 95. Evaluation was made in the same manner as in Example 1 to obtain the results shown in Table 1.

After the honing, the resultant cylinders each had surface roughness of RmaxD=4.1 μm, Rz=2.0 μm, Ra=0.3 μm and Sm=37 μm.

EXAMPLES 96 AND 97

Electrophotographic photosensitive members were produced in the same manner as in Examples 1 and 2, respectively, except that in the wet honing the air spray pressure was changed to 0.18 MPa to obtain products of Examples 96 and 97. Evaluation was made in the same manner as in Example 1 to obtain the results shown in Table 1.

After the honing, the resultant cylinders each had surface roughness of RmaxD=4.5 μm, Rz=2.8 μm, Ra=0.50 μm and Sm=35 μm.

COMPARATIVE EXAMPLES 23 AND 24

Electrophotographic photosensitive members were produced in the same manner as in Examples 1 and 2, respectively, except that in the wet honing the air spray pressure was changed to 0.17 MPa to obtain products of Comparative Examples 23 and 24. Evaluation was made in the same manner as in Example 1 to obtain the results shown in Table 1.

After the honing, the resultant cylinders each had surface roughness of RmaxD=4.3 μm, Rz=2.9 μm, Ra=0.51 μm and Sm=31 μm.

COMPARATIVE EXAMPLES 25 AND 26

Electrophotographic photosensitive members were produced in the same manner as in Examples 1 and 2, respectively, except that in the wet honing method the air spray pressure was changed to 0.29 MPa and the distance between the gun nozzle and the aluminum tube was changed to 250 mm to obtain products of Comparative Examples 25 and 26. Evaluation was made in the same manner as in Example 1 to obtain the results shown in Table 1.

After the honing, the resultant cylinders each had surface roughness of RmaxD=4.9 μm, Rz=2.9 μm, Ra=0.3 μm and Sm=30 μm.

COMPARATIVE EXAMPLES 27 AND 28

Electrophotographic photosensitive members were produced in the same manner as in Examples 1 and 2, respectively, except that in the wet honing method spherical alumina beads of 50 μm in average particle diameter (trade name: CB-50A; available from Showa Denko K.K.) were used as the abrasive grains, the air spray pressure was changed to 0.14 MPa, the honing abrasive grain spray angle was changed to 90°, and the distance between the gun nozzle and the aluminum tube was changed to 110 mm to obtain products of Comparative Examples 27 and 28. Evaluation was made in the same manner as in Example 1 to obtain the results shown in Table 1.

After the honing, the resultant cylinders each had surface roughness of RmaxD=1.7 μm, Rz=1.2 μm, Ra=0.15 μm and Sm=86 μm.

EXAMPLES 98 TO 101

Electrophotographic photosensitive members were produced in the same manner as in Examples 1 to 4, respectively, except that the charge transport layers were each formed in a layer thickness of 8 μm to obtain products of Examples 98 to 101. Evaluation was made in the same manner as in Example 1 to obtain the results shown in Table 1.

EXAMPLES 102 TO 105

Electrophotographic photosensitive members were produced in the same manner as in Examples 1 to 4, respectively, except that the charge transport layers were each formed in a layer thickness of 36 μm to obtain products of Examples 102 to 105. Evaluation was made in the same manner as in Example 1 to obtain the results shown in Table 1.

TABLE 1

| | Evaluation Results | | |
|---|---|---|---|
| | Interference fringes | Black dots or blank areas | Ghost |
| Example | | | |
| 1 | A | A | A |
| 2 | A | A | A |
| 3 | A | A | A |
| 4 | A | A | A |
| 5 | A | B | A |
| 6 | A | B | A |
| 7 | A | A | A |
| 8 | A | A | A |
| 9 | A | A | A |
| 10 | A | A | A |
| 11 | A | B | A |
| 12 | A | B | A |
| 13 | A | A | A |
| 14 | A | A | A |
| 15 | A | A | A |
| 16 | A | A | A |
| 17 | A | A⁻ | A |
| 18 | A | A⁻ | A |
| 19 | A | A | A |
| 20 | A | A | A |
| 21 | A | A | A |
| 22 | A | A | A |
| 23 | A | A⁻ | A |
| 24 | A | A⁻ | A |
| 25 | A | A | A |
| 26 | A | A | A |
| 27 | A | A | A |
| 28 | A | A | A |
| 29 | A | B | A |
| 30 | A | B | A |
| 31 | A | A | A |
| 32 | A | A | A |
| 33 | A | A | A |
| 34 | A | A | A |
| 35 | A | A⁻ | A |
| 36 | A | A⁻ | A |
| 37 | A | A | A |
| 38 | A | A | A |
| 39 | A | A | A |
| 40 | A | A | A |
| 41 | A | A | A |
| 42 | A | A | A |
| 43 | A | A | A |
| 44 | A | A | A |
| 45 | A | A | A |
| 46 | A | A | A |
| 47 | A | A | A |
| 48 | A | A | A |
| 49 | A | A | A |
| 50 | A | B | A |
| 51 | A | B | A |
| 52 | A | A | A |
| 53 | A | A | A |
| 54 | A | A | A |
| 55 | A | A | A |

TABLE 1-continued

| | Evaluation Results | | |
|---|---|---|---|
| | Interference fringes | Black dots or blank areas | Ghost |
| 56 | A | A | A |
| 57 | A | A | A |
| 58 | A | A | A |
| 59 | A | A | A |
| 60 | A | B | A |
| 61 | A | B | A |
| 62 | A | B | A |
| 63 | A | B | A |
| 64 | A | A | A |
| 65 | A | A | A |
| 66 | A | A | A |
| 67 | A | A | A |
| 68 | A | A | A |
| 69 | A | A | A |
| 70 | A | A | A |
| 71 | A | A | A |
| 72 | A | B | A |
| 73 | A | B | A |
| 74 | A | B | A |
| 75 | A | B | A |
| 76 | A | A | A⁻ |
| 77 | A | A | A⁻ |
| 78 | A | A | A⁻ |
| 79 | A | A | A⁻ |
| 80 | A | A | A⁻ |
| 81 | A | A | A⁻ |
| 82 | A | A | A⁻ |
| 83 | A | A | A⁻ |
| 84 | A | A | A |
| 85 | A | A | A |
| 86 | A | A⁻ | A |
| 87 | A | B | A |
| 88 | A | A | A |
| 89 | A | A | A |
| 90 | A | A⁻ | A |
| 91 | A | B | A |
| 92 | A | A | A |
| 93 | A | A | A |
| 94 | A | A | A |
| 95 | A | A | A |
| 96 | A | A⁻ | A |
| 97 | A | B | A |
| 98 | A | B | A |
| 99 | A | B | A |
| 100 | A | B | A |
| 101 | A | B | A |
| 102 | A | A | B |
| 103 | A | A | B |
| 104 | A | A | B |
| 105 | A | A | B |
| Comparative Example | | | |
| 1 | C | A | A |
| 2 | C | A | A |
| 3 | C | A | A |
| 4 | C | A | A |
| 5 | C | A | A |
| 6 | C | A | A |
| 7 | C | A | A |
| 8 | C | A | A |
| 9 | C | A | A |
| 10 | C | A | A |
| 11 | C | A | A |
| 12 | C | A | A |
| 13 | C | A | A |
| 14 | C | A | A |
| 15 | C | A | A |
| 16 | C | A | A |
| 17 | A | C | A |
| 18 | A | C | A |
| 19 | A | C | A |
| 20 | A | C | A |
| 21 | C | A | A |

TABLE 1-continued

| | Evaluation Results | | |
|---|---|---|---|
| | Interference fringes | Black dots or blank areas | Ghost |
| 22 | C | A | A |
| 23 | A | C | A |
| 24 | A | C | A |
| 25 | A | C | A |
| 26 | A | C | A |
| 27 | A | C | A |
| 28 | A | C | A |

As shown in Table 1, in respect of images reproduced by means of the electrophotographic apparatus employing the electrophotographic photosensitive member according to the present invention, any interference fringes and any faulty images much as black dots or blank areas and ghosts do not occur or little occur.

REFERENCE EXAMPLE 1

An electrophotographic photosensitive member was produced in the same manner as in Example 76 except that the hydroxygallium phthalocyanine pigment of the charge generation layer was added in an amount of 6 parts to obtain a product of Reference Example 1.

As a result of the evaluation made in the same manner as in Example 1, the evaluation on the interference fringes was "A" and on the black dots or blank areas "A" according to the above criteria, but the ghost was seen because the charge transport layer was in a layer thickness of 35 $\mu$m and the pigment proportion in the charge generation layer was small. Also, in the halftone images at the time of the evaluation of ghosts, a slight decrease in image density was seen compared with Example 76.

REFERENCE EXAMPLE 2

An electrophotographic photosensitive member was produced in the same manner as in Example 1 except that the hydroxygallium phthalocyanine pigment of the charge generation layer was added in an amount of 16.5 parts to obtain a product of Reference Example 2.

As a result of evaluation made in the same manner as in Example 1, the evaluation on the interference fringes was "A" and on the ghost "A" according to the above criteria, but that on the black dots or blank areas was "C" because of poor film properties of the charge transport layer.

According to the present invention, even though the charge generation layer has a high pigment proportion, the controlling of the surface roughness of the support as stated herein has made it possible to provide an electrophotographic photosensitive member that can contribute to the formation of good images in which any faulty images such as black dots, blank areas and ghosts and any interference fringes do not occur or little occur, and to provide a process cartridge and an electrophotographic apparatus which have such an electrophotographic photosensitive member.

What is claimed is:

1. An electrophotographic photosensitive member comprising an aluminum support, a subbing layer containing a polyamide resin, a charge generation layer and a charge transport layer provided on said aluminum support in this order, wherein said charge transport layer contains a polycarbonate resin as a binder resin, said subbing layer is present on said aluminum support without any intervening layer therebetween and has a thickness from 0.3 μm to 1 μm, said charge generation layer contains a charge-generating material in an amount of more than 2 parts by weight and not more than 5 parts by weight based on 1 part by weight of a binder resin, wherein said charge-generating material is an azo pigment, and said aluminum support has a surface roughness in which a maximum height RmaxD, a 10-point average roughness Rz, an arithmetic-mean roughness Ra and an unevenness average distance Sm fulfill the following conditions:

$$1.2\ \mu m \leqq RmaxD \leqq 5.0\ \mu m,$$

$$1.2\ \mu m \leqq Rz \leqq 3.0\ \mu m,$$

$$0.15\ \mu m \leqq Ra \leqq 0.5\ \mu m,$$

$$30\ \mu m < Sm \leqq 80\ \mu m.$$

2. The electrophotographic photosensitive member according to claim 1, wherein the maximum height RmaxD fulfills the following condition:

$$1.2\ \mu m \leqq RmaxD \leqq 4.5\ \mu m.$$

3. The electrophotographic photosensitive member according to claim 1, wherein the 10-point average roughness Rz fulfills the following condition:

$$1.2\ \mu m \leqq Rz \leqq 2.0\ \mu m.$$

4. The electrophotographic photosensitive member according to claim 1, wherein the arithmetic-mean roughness Ra fulfills the following condition:

$$0.15\ \mu m \leqq Ra \leqq 0.3\ \mu m.$$

5. The electrophotographic photosensitive member according to claim 1, wherein the unevenness average distance Sm fulfills the following condition:

$$31\ \mu m \leqq Sm \leqq 80\ \mu m.$$

6. The electrophotographic photosensitive member according to claim 1, wherein the maximum height RrnaxD, the 10-point average roughness Rz, the arithmetic-mean roughness Ra and the unevenness average distance Sm fulfill the following conditions:

$$1.2\ \mu m \leqq RmaxD \leqq 4.5\ \mu m,$$

$$1.2\ \mu m \leqq Rz \leqq 2.0\ \mu m,$$

$$0.15\ \mu m \leqq Ra \leqq 0.3\ \mu m,$$

$$31\ \mu m \leqq Sm \leqq 80\ \mu m.$$

7. The electrophotographic photosensitive member according to claim 1, wherein the surface of said support has been roughened by liquid honing.

8. The electrophotographic photosensitive member according to claim 1, wherein said azo pigment has a structure represented by the following Formula (1)

(1)

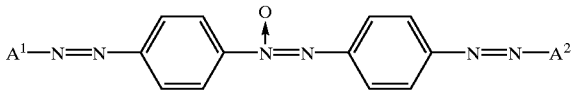

wherein $A^1$ and $A^2$ each represent an aromatic coupler.

9. The electrophotographic photosensitive member according to claim 1, wherein said azo pigment has a structure represented by the following Formula (2)

(2)

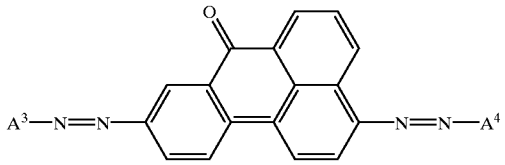

wherein $A^3$ and $A^4$ each represent an aromatic coupler.

10. The electrophotographic photosensitive member according to claim 1, wherein said azo pigment has a structure represented by the following Formula (3)

(3)

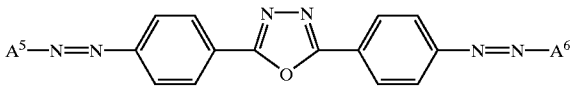

wherein $A^5$ and $A^6$ each represent an aromatic coupler.

11. The electrophotographic photosensitive member according to claim 1, wherein said azo pigment has a structure represented by the following Formula (4)

(4)

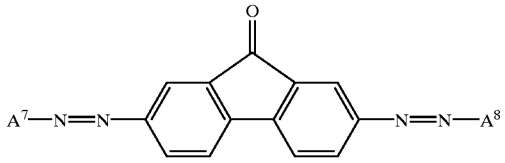

wherein $A^7$ and $A^8$ each represent an aromatic coupler.

12. The electrophotographic photosensitive member according to claim 1, wherein said azo pigment has a structure represented by the following Formula (5)

(5)

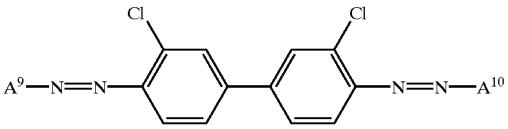

wherein $A^9$ and $A^{10}$ each represent an aromatic coupler.

13. The electrophotographic photosensitive member according to claim 1, wherein said charge transport layer has a layer thickness of from 9 μm to 35 μm.

14. The electrophotographic photosensitive member according to claim 1, wherein said charge transport layer has a layer thickness of from 9 μm to 18 μm.

15. A process cartridge comprising an electrophotographic photosensitive member and a means selected from the group consisting of a charging means for electrostatically charging the electrophotographic photosensitive member, a developing means for developing with a toner an electrostatic latent image formed on the electrophotographic photosensitive member, and a cleaning means for collecting any toner remaining on the electrophotographic photosensitive member after a transfer step;

said electrophotographic photosensitive member and at least one of said means being supported as one unit and being detachably mountable to the main body of an electrophotographic apparatus; and said electrophotographic photosensitive member comprising an aluminum support, a subbing layer containing a polyamide resin, a charge generation layer and a charge transport layer provided on said aluminum support in this order, wherein said charge transport layer contains a polycarbonate resin as a binder resin, said subbing layer is present on said aluminum support without any intervening layer therebetween and has a thickness from 0.3 $\mu$m to 1 $\mu$m, said charge generation layer contains a charge-generating material in an amount of more than 2 parts by weight and not more than 5 parts by weight based on 1 part by weight of a binder resin, wherein said charge-generating material is an azo pigment, and said aluminum support has a surface roughness in which a maximum height RmaxD, a 10-point average roughness Rz, an arithmetic-mean roughness Ra and an unevenness average distance Sm fulfill the following conditions:

$$1.2\ \mu m \leqq RmaxD \leqq 5.0\ \mu m,$$

$$1.2\ \mu m \leqq Rz \leqq 3.0\ \mu m,$$

$$0.15\ \mu m \leqq Ra \leqq 0.5\ \mu m,$$

$$30\ \mu m < Sm \leqq 80\ \mu m.$$

16. An electrophotographic apparatus comprising an electrophotographic photosensitive member, a charging means for charging the electrophotographic photosensitive member electrostatically, an exposure means for subjecting the charged electrophotographic photosensitive member to exposure to form an electrostatic latent image, a developing means for developing with a toner the electrostatic latent image formed on the electrophotographic photosensitive member to form a toner image, and a transfer means for transferring to a transfer medium the toner image formed on the electrophotographic photosensitive member;

said electrophotographic photosensitive member comprising an aluminum support, a subbing layer containing a polyamide resin, a charge generation layer and a charge transport layer provided on said aluminum support in this order, wherein said charge transport layer contains a polycarbonate resin as a binder resin, said subbing layer is present on said aluminum support without any intervening layer therebetween and has a thickness from 0.3 $\mu$m to 1 $\mu$m, said charge generation layer contains a charge-generating material in an amount of more than 2 parts by weight and not more than 5 parts by weight based on 1 part by weight of a binder resin, wherein said charge-generating material is an azo pigment, and said aluminum support has a surface roughness in which a maximum height RmaxD, a 10-point average roughness Rz, an arithmetic-mean roughness Ra and an unevenness average distance Sm fulfill the following conditions:

$$1.2\ \mu m \leqq RmaxD \leqq 5.0\ \mu m,$$

$$1.2\ \mu m \leqq Rz \leqq 3.0\ \mu m,$$

$$0.15\ \mu m \leqq Ra \leqq 0.5\ \mu m,$$

$$30\ \mu m < Sm \leqq 80\ \mu m.$$

* * * * *

UNITED STATES PATENT AND TRADEMARK OFFICE

CERTIFICATE OF CORRECTION

PATENT NO. : 6,656,652 B2
DATED : December 2, 2003
INVENTOR(S) : Shuji Ishii et al.

It is certified that error appears in the above-identified patent and that said Letters Patent is hereby corrected as shown below:

Column 6,
Line 42, “23°.” should read -- 23.2°. --.

Column 7,
Line 28, “diffract” should read -- diffraction --.
Line 32, “7.40°,” should read -- 7.4°, --.
Line 60, “represent” should read -- represents --.

Column 9,
Line 66, “aromatic” should read -- an aromatic --.

Column 10,
Lines 30-37, should be deleted.

Column 18,
Line 27, “shatter” should read -- shutter --.
Line 34, “marines” should read -- machines --.

Column 19,
Line 17, “Seksui” should read -- Sekisui --.

Column 20,
Line 12, “Back” should read -- Black --.

Column 21,
Line 2, “Comparative,” should read -- Comparative --.
Line 31, “BPS150 (SUS304):” should read -- BPS150(SUS304); --.

Column 22,
Line 19, “S-LEC BX-1:” should read -- S-LEC BX-1; --.
Line 22, “1 diameter” should read -- 1mm diameter --.

Column 23,
Line 18, “Seski” should read -- Seiki --.
Line 33, “sane” should read -- same --.

UNITED STATES PATENT AND TRADEMARK OFFICE

CERTIFICATE OF CORRECTION

PATENT NO. : 6,656,652 B2
DATED : December 2, 2003
INVENTOR(S) : Shuji Ishii et al.

It is certified that error appears in the above-identified patent and that said Letters Patent is hereby corrected as shown below:

Column 25,
Line 17, “n” should read -- in --.

Column 30,
Line 36, “sane” should read -- same --.

Column 31,
Line 50, “50 μm,” should read -- 50μm --.

Column 32,
Line 6, “Example ito” should read -- Example 1 to --.

Column 33,
Line 4, “honing the” should read -- honing method, the --.

Signed and Sealed this

Thirteenth Day of July, 2004

JON W. DUDAS
*Acting Director of the United States Patent and Trademark Office*